US008215627B2

(12) United States Patent
Hayashi et al.

(10) Patent No.: US 8,215,627 B2
(45) Date of Patent: Jul. 10, 2012

(54) SHEET PROCESSING APPARATUS AND IMAGE FORMING APPARATUS

(75) Inventors: Kenichi Hayashi, Abiko (JP); Kiyoshi Watanabe, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 167 days.

(21) Appl. No.: 12/498,270

(22) Filed: Jul. 6, 2009

(65) Prior Publication Data

US 2010/0008709 A1 Jan. 14, 2010

(30) Foreign Application Priority Data

Jul. 11, 2008 (JP) ..... 2008-180984
Jun. 22, 2009 (JP) ..... 2009-147447

(51) Int. Cl.
*B31F 1/10* (2006.01)

(52) U.S. Cl. ..... 270/45; 270/32; 270/37; 270/46; 270/51; 270/58.07

(58) Field of Classification Search ..... 270/32, 270/37, 45, 46, 51, 58.07
See application file for complete search history.

(56) References Cited

U.S. PATENT DOCUMENTS

| | | | | |
|---|---|---|---|---|
| 6,575,447 | B2 * | 6/2003 | Yoshie et al. | 270/58.07 |
| 6,692,208 | B1 | 2/2004 | Watkiss et al. | |
| 6,717,286 | B2 * | 4/2004 | Tsuchiya et al. | 270/58.07 |
| 7,207,556 | B2 * | 4/2007 | Saitoh et al. | 270/58.08 |
| 7,285,084 | B2 * | 10/2007 | Fujimoto et al. | 493/442 |
| 2003/0031532 | A1 | 2/2003 | Nolte et al. | |
| 2005/0179191 | A1 * | 8/2005 | Vernetti et al. | 271/4.1 |
| 2005/0189689 | A1 * | 9/2005 | Kushida et al. | 270/37 |
| 2007/0045919 | A1 * | 3/2007 | Hayashi | 270/32 |
| 2008/0099974 | A1 * | 5/2008 | Nomura et al. | 270/58.12 |

FOREIGN PATENT DOCUMENTS

JP 2007-237562 A 9/2007

* cited by examiner

*Primary Examiner* — Leslie A Nicholson, III
(74) *Attorney, Agent, or Firm* — Canon USA Inc. IP Division

(57) ABSTRACT

A sheet processing apparatus that performs bookbinding processing on a folded sheet bundle, includes a holding portion configured to hold a folded sheet bundle, and a pressing member configured to press a folded spinal portion of the sheet bundle held by the holding portion. At least one of the holding portion and the pressing member can move in a direction to approach each other along a surface of the sheet held by the holding portion to press the folded spinal portion of the sheet bundle.

14 Claims, 28 Drawing Sheets

Prior Art

SHEET PROCESSING APPARATUS AND IMAGE FORMING APPARATUS

BACKGROUND OF THE INVENTION

1. Field of the Invention

The present invention relates to a sheet processing apparatus and an image forming apparatus, and more particularly relates to an apparatus that folds a sheet bundle and performs bookbinding processing.

2. Description of the Related Art

There is a conventional image forming apparatus (e.g., a copying machine, a laser beam printer, etc.) equipped with a sheet processing apparatus that can appropriately fold respective sheets discharged from the image forming apparatus, or stitch the sheets along their center lines and then fold the stitched sheets for saddle stitch bookbinding.

In the saddle stitch bookbinding processing, if the number of sheets constituting a sheet bundle is large (e.g., 20 or more) and the bundle of sheets is bent for bookbinding, a folded spinal portion of a finished product has a curvature. The sheet bundle finished in this manner is generally insufficient in foldness and may open somewhat even after the sheet bundle is firmly pressed and folded. Therefore, the finished product does not look nice. If numerous sheet bundles are stacked in the vertical direction, their surfaces may not be held horizontally due to irregularity in thickness.

To eliminate such drawbacks, as discussed in U.S. Pat. No. 6,692,208, or US Pub2003/0031532, a conventional sheet processing apparatus includes a pressing roller that can travel along a folded spinal portion (i.e., a bent portion) of a folded sheet bundle while pressing the folded spinal portion to corner (smooth) a curvature of the folded spinal portion.

FIGS. 27A to 27C illustrate an example configuration of a conventional sheet processing apparatus. When the sheet processing apparatus performs processing for cornering a folded spinal portion of a sheet bundle as a deforming process, a pair of belt conveyors 16 and 17 conveys a folded sheet bundle SA until the folded spinal portion collides against a positioning member 15 as illustrated in FIG. 27A. After the folded spinal portion abuts against the positioning member 15, the belt conveyors 16 and 17 continuously rotate a predetermined amount to further convey the sheet bundle SA while causing slip on their surfaces. This is effective to correct a skew of the sheet bundle SA and accurately adjust the position of the sheet bundle SA.

Next, as illustrated in FIG. 27B, the sheet bundle SA is held between a pair of grip portions 12 and 13 with its folded spinal portion in a protruded state. Namely, the grip portions 12 and 13 cooperatively fix the sheet bundle SA at a position adjacent to the folded spinal portion. The positioning member 15 moves to a retreat position. Then, as illustrated in FIGS. 28A and 28B, a pressing roller 14 travels in a direction indicated by an arrow while pressing a folded spinal portion of the curved sheet bundle SA that protrudes from the grip portions 12 and 13. Thus, the folded spinal portion of the curved sheet bundle SA can be cornered and smoothed. Then, as illustrated in FIG. 27C, the belt conveyors 16 and 17 convey and discharge the cornered (i.e., smoothed) sheet bundle SA to a sheet discharge tray 18.

In the above-described conventional sheet processing apparatus, the pressing roller 14 is located at a predetermined retreat position before performing the processing for cornering a folded spinal portion so as not to interfere with a sheet bundle being conveyed. The retreat position of the pressing roller 14 is moved from a conveyance path along which the sheet bundle is conveyed in a direction perpendicular to the sheet bundle conveyance direction (hereinafter, referred to as a "width direction"). When the pressing roller 14 starts cornering the folded spinal portion of the sheet bundle SA positioned by the positioning member 15, the pressing roller 14 moves from the retreat position (i.e., one end side) to the other end side of the folded spinal portion while pressing the folded spinal portion.

However, when the pressing roller 14 moves from the retreat position to the other end side of the folded spinal portion, the pressing roller 14 may strongly hit a side edge of the folded spinal portion and may damage (e.g., curl) an edge portion of the sheet bundle SA.

Moreover, when the pressing roller 14 moves along a folded spinal portion while pressing a cover sheet of the sheet bundle SA, the cover sheet may slightly move together with the pressing roller 14. Therefore, the cover sheet may slide relative to inner sheets and may be torn from a binding portion. This problem specifically arises in a case where the cover sheet is thin and the number of sheets is large.

SUMMARY OF THE INVENTION

Exemplary embodiments of the present invention are directed to a sheet processing apparatus and an image forming apparatus that can corner a folded spinal portion (i.e., a front end of a folded portion) of a sheet bundle without damaging the sheet bundle.

According to an aspect of the present invention, a sheet processing apparatus performs bookbinding processing on a folded sheet bundle. The sheet processing apparatus includes a holding portion configured to hold a folded sheet bundle and a pressing member configured to press a folded spinal portion of the sheet bundle held by the holding portion. At least one of the holding portion and the pressing member can move in a direction to approach each other along a surface of the sheet held by the holding portion to press the folded spinal portion of the sheet bundle.

According to an exemplary embodiment of the present invention, a folded spinal portion of a sheet bundle held in a protruded state can be cornered by moving at least one of the holding portion and the pressing member while pressing a pressing surface of the pressing member, without damaging the sheet bundle.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments and features of the invention and, together with the description, serve to explain at least some of the principles of the invention.

DETAILED DESCRIPTION OF THE EMBODIMENTS

Figure 1:
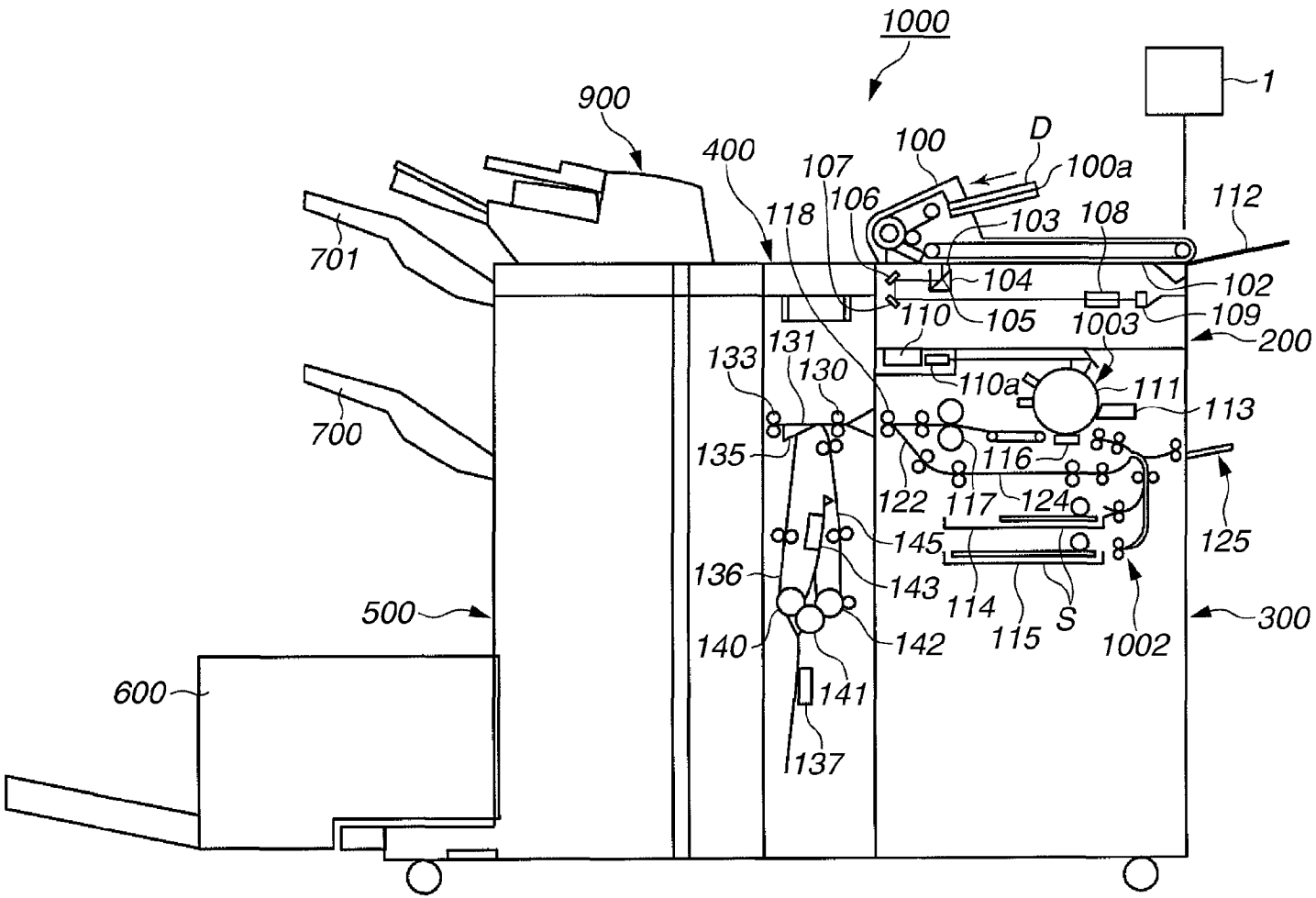
FIG. 1 is a cross-sectional view of a copying machine that can serve as an example of an image forming apparatus including a sheet processing apparatus according to a first exemplary embodiment of the present invention.

The following description of exemplary embodiments is illustrative in nature and is in no way intended to limit the invention, its application, or uses. It is noted that throughout the specification, similar reference numerals and letters refer to similar items in the following figures, and thus once an item is described in one figure, it may not be discussed for following figures. Various exemplary embodiments, features, and aspects of the invention will be described in detail below with reference to the drawings.

FIG. 1 is a cross-sectional view of a copying machine that can serve as an example of an image forming apparatus including a sheet processing apparatus according to an exemplary embodiment of the present invention.

In FIG. 1, a copying machine 1000 includes a copying machine body 300 and a scanner 200 disposed on an upper surface of the copying machine body 300.

The scanner 200, which is configured to read a document, includes a document feeding portion 100, a scanner unit 104, a lens 108, and an image sensor 109. When the scanner 200 reads a document D, a user sets the document D on a tray 100*a* of the document feeding portion 100. For example, the document D may be placed on the tray 100*a* in a face-up state where an image-formed surface of the document D faces upward.

Next, the document feeding portion 100 successively conveys sheets of the document D being set in this manner to the left (i.e., an arrow direction in FIG. 1) one after another from its head page. The document feeding portion 100 conveys each sheet to a platen glass 102 via a curved path and further conveys the sheet from left to right on the platen glass 102, and finally discharges the sheet to a sheet discharge tray 112.

In this case, if the document feeding portion 100 performs a feeding-reading operation for document reading, the scanner unit 104 is stationarily held at a predetermined position to read the document D that travels from left to right above the scanner unit 104. In the reading processing, the document D is irradiated with light emitted from a lamp 103 of the scanner unit 104 while the document D moves on the platen glass 102. Reflection light from the document D is guided to the image sensor 109 by mirrors 105, 106, and 107 and the lens 108. The image sensor 109 reads the document D. Then, predetermined image processing is performed on the image data read by the image sensor 109. The processed image data is then sent to the exposure control portion 110.

If the document feeding portion 100 performs a fixed-reading operation for document reading, the document feeding portion 100 temporarily stops the conveyed document D on the platen glass 102 while the scanner unit 104 moves from left to right to perform document reading processing. If a user does not use the document feeding portion 100, the user can lift the document feeding portion 100 and manually set the document on the platen glass 102.

The copying machine body 300 includes a sheet feeding portion 1002 configured to feed a sheet S from a cassette 114 or 115 and an image forming portion 1003 configured to form an image of the sheet S fed by the sheet feeding portion 1002.

The image forming portion 1003 includes a photosensitive drum 111, a development device 113, and a transfer charging device 116. A latent image can be formed on the photosensitive drum 111 when the photosensitive drum 111 is irradiated with a laser beam emitted from the exposure control portion 110. The latent image can be visualized as a toner image by the development device 113. A fixing portion 117 and a discharge roller pair 118 are disposed on a downstream side of the image forming portion 1003 in the conveyance direction.

The copying machine body 300 can perform an image forming operation with the above-described configuration.

The image data of the document D read by the image sensor 109 as described above, when the scanner 200 performs a feeding-reading or fixed-reading operation, is subjected to predetermined image processing and sent to the exposure control portion 110. The exposure control portion 110 outputs a laser beam corresponding to the received image signal. In synchronization with a scanning operation of a polygonal mirror 110*a*, the photosensitive drum 111 is irradiated with the laser beam emitted from exposure control portion 110. An electrostatic latent image can be formed on the photosensitive drum 111 according to the scanned laser beam. The development device 113 can develop the electrostatic latent image formed on the photosensitive drum 111 and visualize it as a toner image.

The sheet S can be conveyed from any one of the cassettes 114 and 115, a manual sheet feeding portion 125, and a two-sided conveyance path 124 to a transfer portion, which can be constituted by the photosensitive drum 111 and the transfer charging device 116. The transfer portion can transfer the toner image visualized on the photosensitive drum 111 to the sheet S. The fixing portion 117 performs fixing processing on the sheet S supplied from the transfer portion.

A switching member (not illustrated) guides the sheet S having passed through the fixing portion 117 to a path 122. In the path 122, the sheet S causes a switchback motion after a rear end of the sheet S has passed through the switching member in the conveyance direction. Then, the switching member conveys the sheet S to the discharge roller pair 118. The discharge roller pair 118 discharges the sheet S out of the copying machine body 300. In this case, the sheet S discharged from the copying machine body 300 is in a face-down state where a toner image formed surface of the sheet S faces downward.

With the above-described reverse discharge operation, the sheet S can be discharged in a face-down state. Thus, when the image forming processing is performed successively from a head page of a document, for example, when the image forming processing is performed on image data supplied from a computer, the processed sheets with images formed thereon can be set according to the page order. If the sheet S to be subjected to the image forming processing is a hard sheet (e.g., an OHP sheet conveyed from the manual sheet feeding portion 125), the sheet S is not guided to the path 122 and the roller pair 118 discharges the sheet S from the copying machine body 300 in a face-up state where the toner image formed surface of the sheet S faces upward.

In a case where the copying machine performs image forming processing on both surfaces of the sheet S, the sheet S is directly guided from the fixing portion 117 to the roller pair 118. The sheet S causes a switchback motion immediately after the rear end of the sheet S has passed through the switching member in the conveyance direction. Then, the sheet S is guided to the two-sided conveyance path 124 by the switching member.

The copying machine body 300 is associated with a folding processing portion 400. The folding processing portion 400 can fold sheets having been subjected to image forming processing and discharged from the copying machine body 300. The folding processing portion 400 is connected to a finisher 500 that has the capability of stitching sheets or performing bookbinding processing.

The folding processing portion 400 includes a conveyance path 131 that can receive a sheet discharged from the copying machine body 300 and guide the sheet to the finisher 500. A conveyance roller pair 130 and discharge rollers 133 are provided in the conveyance path 131. A switching member 135 is provided in the vicinity of the discharge rollers 133. The switching member 135 can guide a sheet conveyed by the conveyance roller pair 130 to a folding path 136 or to the finisher 500.

When the folding processing portion 400 performs folding processing on sheets, the folding processing portion 400 switches the switching member 135 to guide a sheet to the folding path 136. The sheet guided to the folding path 136 collides with a stopper 137 at a front end thereof in the conveyance direction. The sheet starts deforming into a loop shape in a state where the front end of the sheet is stopped by the stopper 137.

The sheet deformed into a loop shape is then folded by a pair of folding rollers 140 and 141 to form a folded portion.

Next, the folded portion collides with an upper stopper 143 to form another loop. The loop portion is then folded by another pair of folding rollers 141 and 142. As a result, the sheet can be folded into a Z shape. The sheet folded into the Z shape is sent via the conveyance path 145 to the conveyance path 131. The discharge rollers 133 discharge the Z-folded sheet to the finisher 500, which is located on the downstream side in the conveyance direction.

The folding processing portion 400 can selectively perform the folding processing. If no folding processing is necessary, the folding processing portion 400 switches the switching member 135 to directly guide a sheet discharged from the copying machine body 300 to the finisher 500 via the conveyance path 131.

Figure 2:
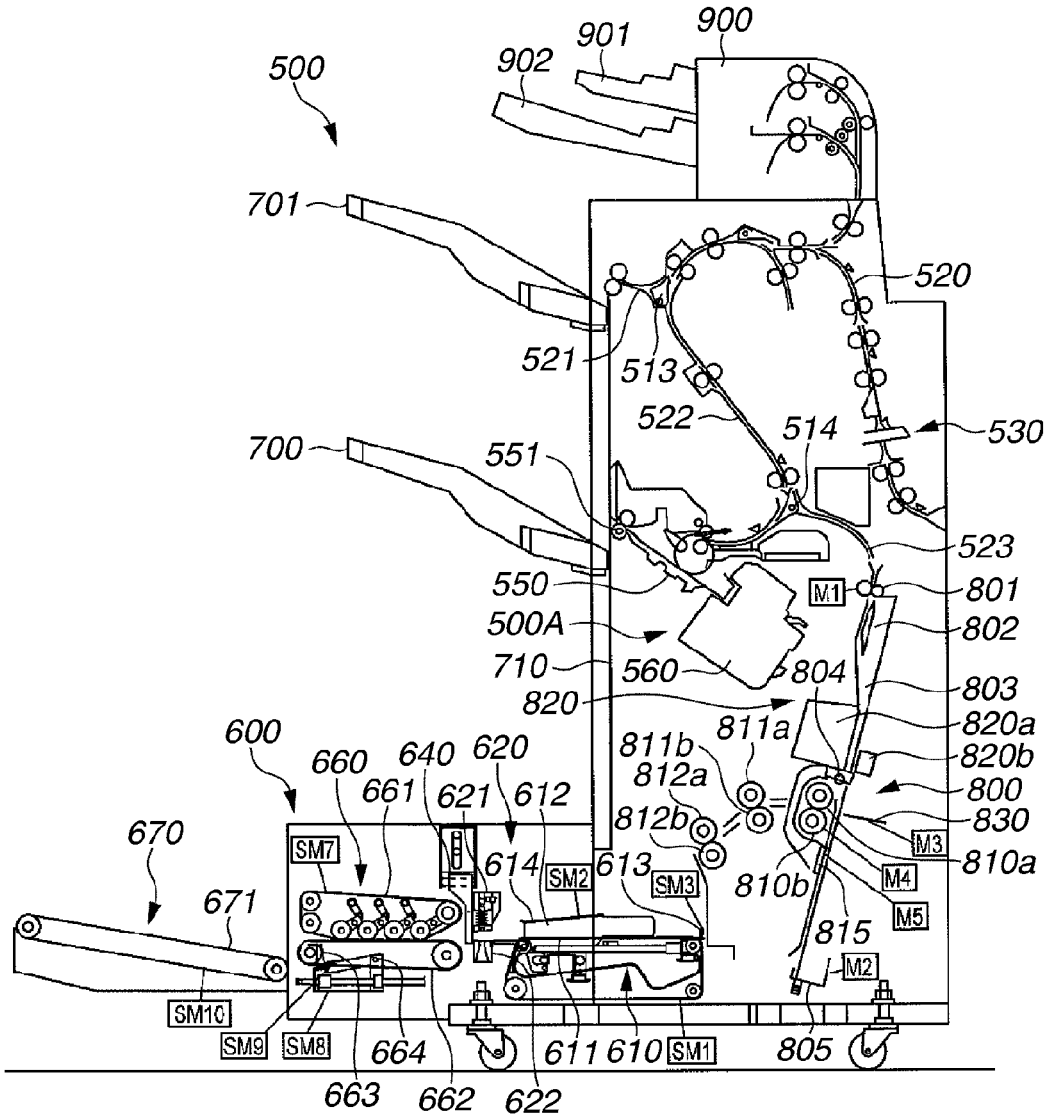
FIG. 2 illustrates a configuration of a finisher that can serve as the sheet processing apparatus.

Each sheet S with an image formed thereon is conveyed into the finisher 500 via the folding processing portion 400. The finisher 500 can perform various processing on sheets received from the copying machine body 300. More specifically, the finisher 500 performs processing for aligning a plurality of sheets and bundling the aligned sheets as a single sheet bundle, as well as sort processing and non-sort processing. The finisher 500 can further perform staple processing (i.e., binding processing) for stapling the rear end side of the sheet bundle in the conveyance direction and bookbinding processing. As illustrated in FIG. 2, the finisher 500 includes a staple portion 500A that can staple a plurality of sheets and a saddle stitch binding portion 800 (i.e., a bookbinding portion) that can fold the sheet bundle for bookbinding.

The finisher 500, as illustrated in FIG. 2, includes a conveyance path 520 via which the sheet conveyed from the folding processing portion 400 can be supplied to the inside of the apparatus. A plurality of conveyance roller pairs is provided along the conveyance path 520. A punch unit 530, which is provided near the conveyance path 520, can perform punching processing on the rear edge portion of a sheet conveyed in the conveyance direction.

A switching member 513 is provided at a rear end of the conveyance path 520. The switching member 513 can switch the conveyance path to an upper sheet discharge path 521 or a lower sheet discharge path 522 that are connected to the downstream side in the conveyance direction. The upper sheet discharge path 521 can be used to discharge a sheet to an upper stack tray 701. The lower sheet discharge path 522 can be used to discharge a sheet to a process tray 550.

The sheets discharged via the lower sheet discharge path 522 to the process tray 550 are successively subjected to alignment processing and are accommodated as a bundle. The sheets are further subjected to sorting processing and staple processing according to user's settings entered via the operation portion 1 illustrated in FIG. 1. A stapler 560, which is movable in the width direction, performs staple processing on the sheets at arbitrary positions.

The sheets having been subjected to the sorting processing and the staple processing are discharged by a bundle discharge roller pair 551 to the upper stack tray 701 or a lower stack tray 700. A rear end guide 710, which extends in the vertical direction, can regulate and align the rear ends of the sheets discharged in the upper and lower stack trays 700 and 701.

The upper stack tray 701 and the lower stack tray 700 are movable in the vertical direction. The upper stack tray 701 can receive sheets from the upper sheet discharge path 521 and the process tray 550. The lower stack tray 700 can receive sheets from the process tray 550. A great amount of sheets can be stored in the upper stack tray 701 and the lower stack tray 700 by moving the upper stack tray 701 and the lower stack tray 700 in the vertical direction.

As illustrated in FIG. 2, an inserter 900 is provided on the finisher 500. The inserter 900 can supply head and final pages to be added to a sheet bundle and can insert an insert sheet (i.e., a sheet different from the sheets constituting the sheet bundle) between sheets on which images are formed by the copying machine body 300.

When an insert sheet is inserted, the inserter 900 supplies the insert sheet set on the insert tray 901 or 902 by a user to the conveyance path 520 at desired timing. Then, the insert sheet supplied to the conveyance path 520 can be conveyed to any one of the upper stack tray 701, the process tray 550, and the saddle stitch binding portion 800.

A switching member 514 is provided at a predetermined position of the lower sheet discharge path 522. When the finisher 500 performs saddle stitch processing on sheets, the switching member 514 switches the conveyance path to guide the sheets to a saddle sheet discharge path 523. The sheets are conveyed to the saddle stitch binding portion 800. More specifically, a sheet having passed through the saddle sheet discharge path 523 is received by a saddle inlet roller pair 801. A switching member 802, which can be driven by a solenoid, selects an inlet port according to a size of the conveyed sheet. The sheet is conveyed into an accommodating guide 803 of the saddle stitch binding portion 800.

A sliding roller 804 conveys the entered sheet until the front end of the sheet in the conveyance direction reaches a movable sheet positioning member 805. The saddle inlet roller pair 801 and the sliding roller 804 can be driven by a motor M1. A stapler 820 is provided near the accommodating guide 803. The stapler 820 includes a driver 820*a* and an anvil 820*b* which are positioned in a confronting relationship on the opposite sides of the accommodating guide 803. The driver 820*a* can push out a staple (not illustrated). The anvil 820*b* can bend distal ends of the protruded staple.

The sheet positioning member 805 is movable in the vertical direction when it is driven by a motor M2. The sheet positioning member 805 can change its vertical position according to the size of each sheet. When a conveyed sheet is stopped by the sheet positioning member 805, a central portion of the sheet in the conveyance direction agrees with a stitch position of the stapler 820.

A pair of folding rollers 810*a* and 810*b* is provided on the downstream side of the stapler 820 in the conveyance direction. A pushing member 830 is provided in a confronting relationship with the folding rollers 810*a* and 810*b*. The pushing member 830 retreats from the accommodating guide 803 at its home position and can protrude toward an accommodated sheet bundle when it is driven by a motor M3.

When the pushing member 830 protrudes toward the sheet bundle and presses the sheet bundle, the sheet bundle is folded and nipped by the folding rollers 810*a* and 810*b*. This operation is referred to as folding processing. An alignment plate pair 815 has a surface that surrounds the folding rollers 810*a* and 810*b* and protrudes against the accommodating guide 803. The alignment plate pair 815 can align a plurality of sheets stored in the accommodating guide 803. The alignment plate pair 815 can move in a nipping direction relative to the sheets, when it is driven by a motor M5. The sheets can be positioned in the width direction by the alignment plate pair 815.

The folding rollers 810*a* and 810*b* are pressed against each other by a spring (not illustrated) that gives a sufficient pressing force F1 to fold the sheet bundle. The pushing member 830 returns to the home position again after the sheet bundle is nipped between the folding rollers 810*a* and 810*b*.

A pair of first folding conveyance rollers 811*a* and 811*b* and a pair of second folding conveyance rollers 812*a* and 812*b* can discharge the sheet bundle to a saddle stitch booklet processing portion 600. The first folding conveyance rollers 811*a* and 811*b* are pressed against each other by a resilient member (not illustrated) that gives a sufficient pressing force to convey and stop the sheet bundle. Similarly, the second folding conveyance rollers 812*a* and 812*b* are pressed against each other by a resilient member (not illustrated) that gives a sufficient pressing force to convey and stop the sheet bundle. A single motor M4 (i.e., a common motor) can drive the folding rollers 810*a* and 810*b*, the first folding conveyance rollers 811*a* and 811*b*, and the second folding conveyance rollers 812*a* and 812*b* so that these rollers can synchronously rotate at the same speed.

Figure 3:
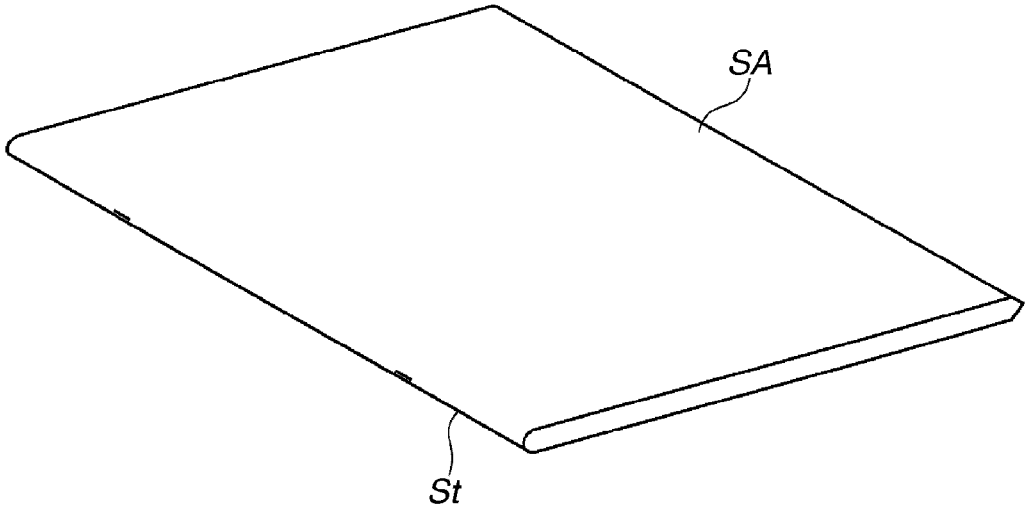
FIG. 3 is a perspective view illustrating a booklet that can be obtained by a saddle stitch binding portion of the finisher.

After finishing the staple processing, the sheet positioning member 805 moves downward a predetermined distance from the position where the sheet bundle has been subjected to the staple processing, so that the staple position of the sheet bundle agrees with the nip position of the folding rollers 810*a* and 810*b*. Then, a booklet (i.e., a sheet bundle) SA can be obtained by folding the sheet bundle along a line corresponding to the staple position as illustrated in FIG. 3.

Figure 4:
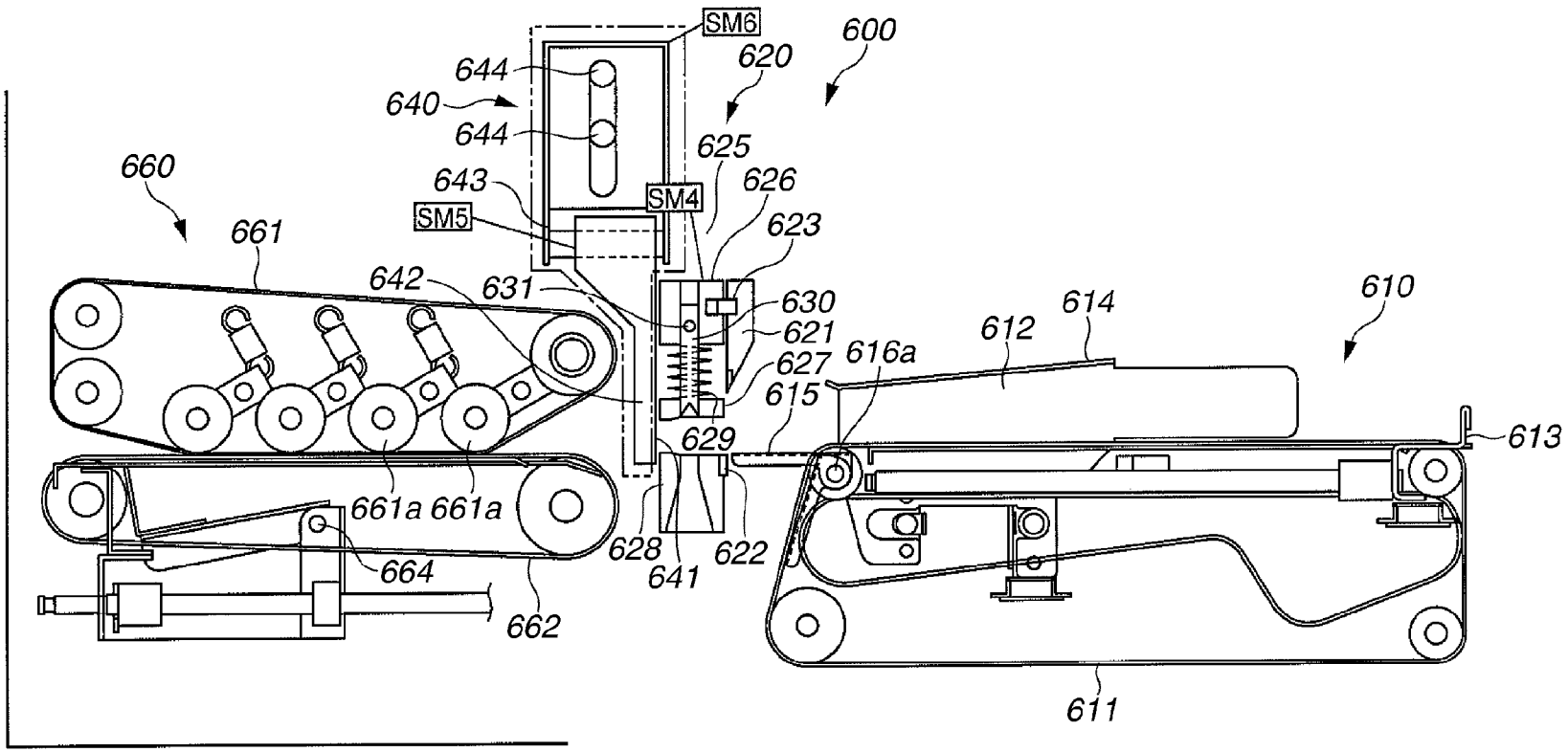
FIG. 4 illustrates a configuration of a saddle stitch booklet processing portion provided in the finisher.

In the present exemplary embodiment, as illustrated in FIG. 2, the saddle stitch booklet processing portion 600 is provided on the downstream side of the saddle stitch binding portion 800 in the conveyance direction. The saddle stitch booklet processing portion 600 can perform finishing processing on a folded spinal portion (i.e., a folded portion) of a booklet (i.e., a sheet bundle finished by the saddle stitch bookbinding processing). The saddle stitch booklet processing portion 600 includes a booklet reception portion 610, a booklet processing unit 620, and a bundle conveyance portion 660, as illustrated in FIG. 4.

The booklet reception portion 610 receives a sheet bundle from the saddle stitch binding portion 800 and conveys the received bundle. To this end, the booklet reception portion 610 includes a lower conveyance belt 611 that can receive a sheet bundle from the saddle stitch binding portion 800 and convey the received bundle. The lower conveyance belt 611 is rotating in the conveyance direction when the lower conveyance belt 611 receives the sheets. Therefore, even if a sheet bundle falls from the second folding conveyance rollers 812*a* and 812*b*, the sheet bundle does not rotate and can be received by the lower conveyance belt 611 without changing its orientation in the conveyance direction.

A side guide pair 612 is positioned across the lower conveyance belt 611, in such a manner as to extend in the width direction perpendicular to the conveyance direction of the lower conveyance belt 611. The side guide pair 612 can move in the width direction of a sheet bundle to correct the position of the sheet bundle in the width direction. A holding guide 614, which is formed on an upper side of the side guide pair 612, can prevent a sheet bundle from opening. The holding guide 614 can function as a guide capable of smoothly conveying each sheet bundle to the downstream side in the conveyance direction.

Figure 6:
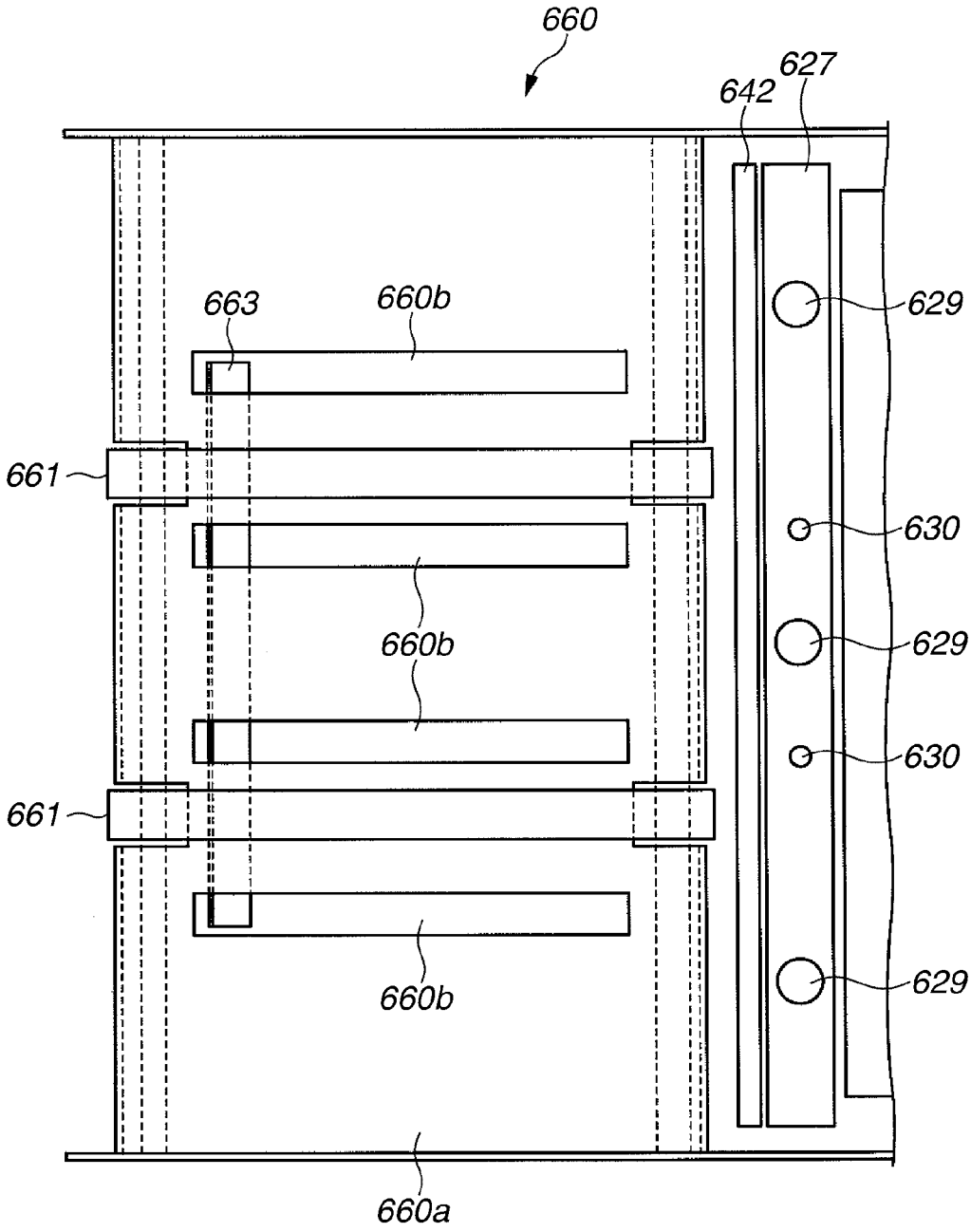
FIG. 6 illustrates a configuration of a bundle conveyance portion provided in the saddle stitch booklet processing portion.

Conveyance claws 613 are disposed on both sides of the lower conveyance belt 611 in the width direction. The conveyance claws 613 can move in parallel with the lower conveyance belt 611 at the same speed as illustrated in FIG. 6. If any slip is caused between a sheet bundle and the lower conveyance belt 611, the conveyance claws 613 contact a rear end of the sheet bundle in the conveyance direction and push the sheet bundle while it moves.

In this manner, the conveyance claws 613 provided as pushing members can surely push the rear end of each sheet bundle to the downstream side in the conveyance direction and can press the folded spinal portion of the sheet bundle against a pressing member 642 as described below. The lower conveyance belt 611, the side guide pair 612, and the conveyance claws 613 can be driven by motors SM1, SM2, and SM3 illustrated in FIG. 2, respectively.

Figure 5:
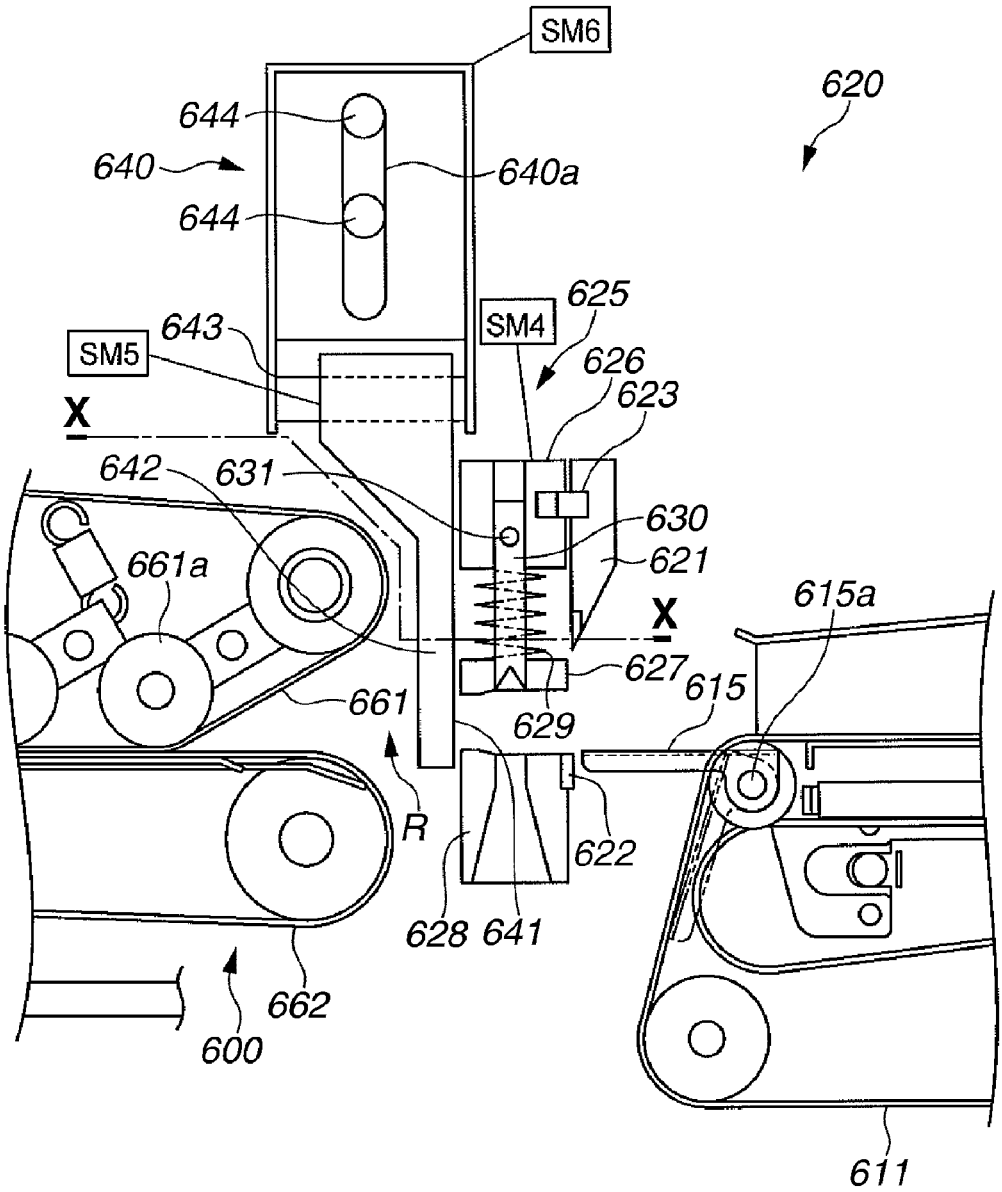
FIG. 5 illustrates a configuration of a booklet processing unit provided in the saddle stitch booklet processing portion.

The booklet processing unit 620 includes upper and lower cutting blades 621 and 622 that can cut a sheet bundle as illustrated in FIG. 5. The booklet processing unit 620 further includes a holding unit 625 and a punch 630. The holding unit 625 can serve as a holding portion configured to hold a sheet bundle in the vertical direction. The punch 630, which is disposed in the holding unit 625, can open a hole at a predetermined position of the sheet bundle. The booklet processing unit 620 further includes a cornering unit 640 that can regulate the position of a front end (i.e., a folded spinal portion) of a sheet bundle in the conveyance direction. The cornering unit 640 can push and corner a curved front end of the folded spinal portion.

The holding unit 625 includes a holding base 626, an upper holding plate 627, and a lower holding plate 628. The holding base 626 can move in the vertical direction when it is driven by a motor SM4. The upper holding plate 627 is connected to the holding base 626 via a connection member (not illustrated). The lower holding plate 628 is fixed to a frame in an opposed relationship with the upper holding plate 627. A compression spring 629 is disposed between the holding base 626 and the upper holding plate 627.

As illustrated in FIG. 5, in a state where the holding base 626 is located at an upper predetermined standby position (hereinafter, referred to as an upper position), the upper and lower holding plates 627 and 628 are separated so that a sheet bundle can be conveyed into an opened space between two plates 627 and 628. In a state where the holding base 626 is located at a down position (hereinafter, referred to as a lower position) where a sheet bundle is processed, the compression spring 629 expands or shrinks according to the thickness of each sheet bundle while the upper and lower holding plates 627 and 628 surely grip and fix the sheet bundle.

The lower cutting blade 622 is fixed to an upstream end of the lower holding plate 628 in the conveyance direction. The upper cutting blade 621 is constantly urged upward by a spring (not illustrated). In a state where the holding base 626 is located at the upper position, the upper cutting blade 621 can be connected to the holding base 626 via a first connecting pin 623.

The first connecting pin 623 can be driven by a solenoid (not illustrated), which can selectively connect or disconnect the holding base 626 with or from the upper cutting blade 621. If the holding base 626 moves downward in a state where the holding base 626 and the upper cutting blade 621 are connected with the first connecting pin 623, the upper cutting blade 621 moves together with the lowering holding base 626. Then, the upper cutting blade 621 and the lower cutting blade 622 cooperatively cut a sheet bundle.

The punch 630 can slide in vertical holes of the holding base 626 and the upper holding plate 627. Similar to the upper cutting blade 621, the punch 630 is constantly urged upward by a spring (not illustrated). The punch 630 can be connected to the holding base 626 at the upper position via a second connecting pin 631. The second connecting pin 631 can be driven by a solenoid (not illustrated), which can selectively connect or disconnect the holding base 626 with or from the punch 630.

If the holding base 626 moves downward in a state where the holding base 626 and the punch 630 are connected with the second connecting pin 631, the punch 630 moves together with the lowering holding base 626 and reaches a receiving hole of the lower holding plate 628 to open a punch hole at a predetermined position of a sheet bundle. In the present exemplary embodiment, the shape of a punch hole may be a circular one. Two punch holes may be opened in the back-and-forth direction to realize a two-hole punch. The punch 630 has a front end configured into a V-shaped groove, which can reduce a resistive force that may act when a bundle is punched.

The pressing member 642 of the cornering unit 640 has a flat pressing surface 641 against which the front end (folded portion) of a sheet bundle can collide. The pressing member 642 is supported by a rail 643 and can be driven by a motor SM5 in such a way as to move in parallel with the conveyance direction. The pressing member 642 can be brought into contact with the holding unit 625 and can be separated from the holding unit 625. Namely, the cornering unit 640 travels in a direction along a surface of a sheet bundle held by the holding unit 625 while performing processing for cornering a curved front end (i.e., a folded portion) of the sheet bundle served as a deforming process.

The cornering unit 640 includes an elongated guide hole 640*a* extending in the vertical direction. Two shafts 644, which are fixed to a frame, are inserted in the guide hole 640*a*. The cornering unit 640, when it is driven by a motor SM6, can move in the vertical direction while the shafts 644 are guided along the guide hole 640*a*. The pressing member 642 can retreat from the conveyance path R when the cornering unit 640 moves upward and reaches the upper position. In this state, a sheet bundle can be freely conveyed.

On the other hand, if the cornering unit 640 moves downward and reaches the lower position as illustrated in FIG. 5, the pressing member 642 protrudes across the conveyance path R and blocks the conveyance path R. In this state, the folded spinal portion of a conveyed sheet bundle collides against the pressing member 642 and is stopped.

In FIG. 5, a shutter guide 615 is provided to surely convey a sheet bundle from the booklet reception portion 610 to the booklet processing unit 620. The shutter guide 615 can swing in a vertical plane around a pulley shaft 615*a* of the lower conveyance belt 611 in synchronization with an up-and-down motion of the upper cutting blade 621. The shutter guide 615 is linked with the upper cutting blade 621 via a cam (not illustrated) fixed to the upper cutting blade 621.

When a sheet bundle is conveyed in a state where the holding base 626 and the upper cutting blade 621 are located at the upper position, the shutter guide 615 guides the sheet bundle horizontally as illustrated in FIG. 5 (see a solid line position). When the upper cutting blade 621 moves downward and cuts a sheet bundle, the shutter guide 615 rotates downward to let scrap fall from the conveyance path R (see a dotted line position).

The bundle conveyance portion 660, which is capable of conveying a sheet bundle, includes upper and lower conveyance belts 661 and 662 that can travel at the same speed to convey a sheet bundle nipped between them. The upper conveyance belt 661 is associated with a plurality of guide rollers 661*a*, which support the upper conveyance belt 661 from the inside. The position of each guide roller 661*a* is changeable according to the thickness of each sheet bundle.

A positioning stopper 663 is positioned in the vicinity of the lower conveyance belt 662, as illustrated in FIG. 6. The positioning stopper 663 can move in the conveyance direction in parallel with the lower conveyance belt 662. The positioning stopper 663 can swing around a pivot shaft 664 illustrated in FIG. 4 between a position where the positioning stopper 663 retreats from the conveyance path and a position where the positioning stopper 663 protrudes from a guide member 660*a* that constitutes a bottom surface of the conveyance path via elongated holes 660*b* extending in the conveyance direction. A motion of the upper and lower conveyance belts 661 and 662, a motion of the positioning stopper 663, and a swing motion of the positioning stopper 663 can be driven by motors SM7, SM8, and SM9 illustrated in FIG. 2.

In FIG. 2, a conveyor tray 670 can receive a sheet bundle when it is discharged from the bundle conveyance portion 660. A conveyor belt 671, which is provided on a lower surface of the conveyor tray 670, can travel in the conveyance direction when it is driven by a motor SM10. The conveyor belt 671 repeats a predetermined amount of movement every time when a sheet bundle is discharged to perform loading of sheet bundles. A sensor (not illustrated) can detect the position of each movable member.

Figure 7:
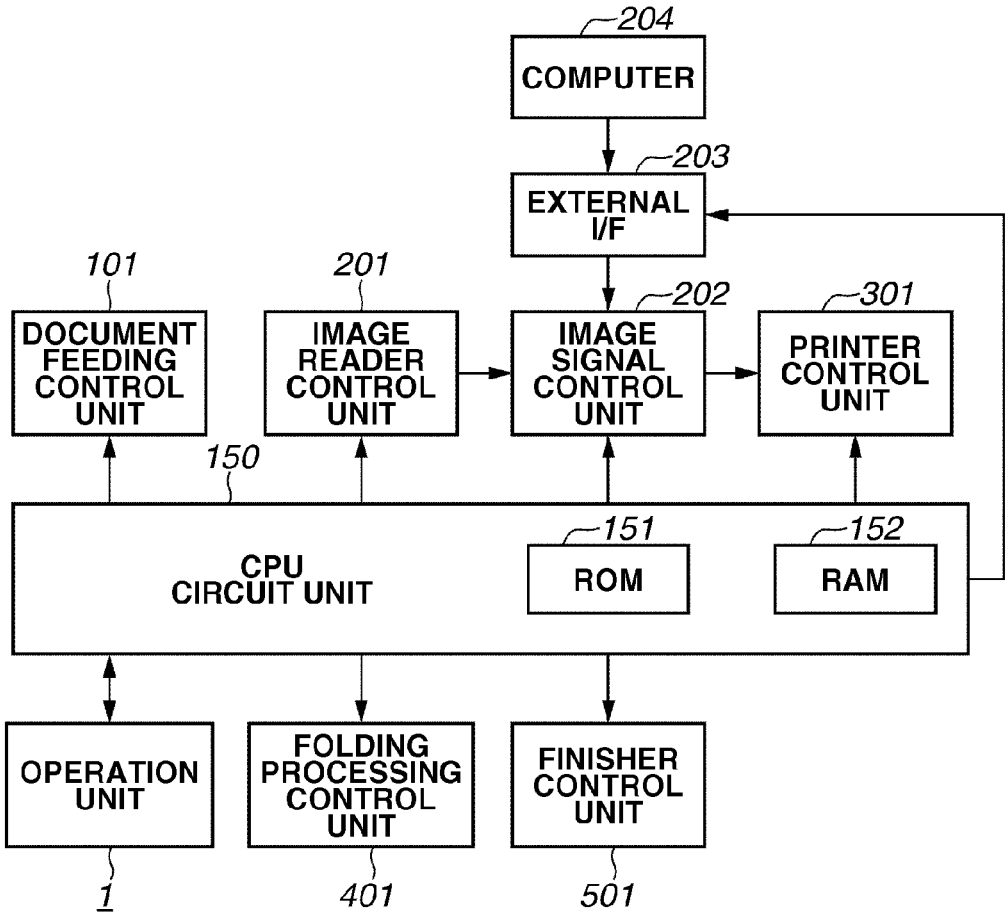
FIG. 7 is a control block diagram of the copying machine.

FIG. 7 is a control block diagram of the copying machine 1000. A central processing portion (CPU) circuit portion 150 includes a CPU (not illustrated) that can control a document feeding control portion 101, an image reader control portion 201, an image signal control portion 202, a printer control portion 301, and a folding processing control portion 401 according to a control program stored in a read only memory (ROM) 151 and user's settings entered via the operation portion 1. The CPU can further control a finisher control portion 501 and an external I/F 203.

The document feeding control portion 101 controls the document feeding portion 100. The image reader control portion 201 controls the scanner 200. The printer control portion 301 controls the copying machine body 300. The folding processing control portion 401 controls the folding processing portion 400. The finisher control portion 501 controls various operations performed by the finisher 500 that includes the saddle stitch booklet processing portion 600, the saddle stitch binding portion 800, and the inserter 900.

In FIG. 7, the operation portion 1 of the copying machine body 300 includes a plurality of keys that enable users to set various functions relating to image forming processing and a display portion that can display a state of settings. The operation portion 1 sends a key signal representing a user's operation on each key to the CPU circuit portion 150. The operation portion 1 displays corresponding information on its display portion based on a signal received from the CPU circuit portion 150.

A random access memory (RAM) 152 can be used as a storage area that temporarily stores control data and a work area usable for calculations in various controls. The external I/F 203 can serve as an interface between the copying machine 1000 and an external computer 204. When the external I/F 203 receives print data from the computer 204, the external I/F can rasterize the received data into a bitmap image. The external I/F 203 outputs image data of the bitmap image to the image signal control portion 202. The image reader control portion 201 receives an image of a document read by an image sensor (not illustrated) and outputs the image to the image signal control portion 202. The printer control portion 301 receives image data from the image signal control portion 202 and outputs the image data to the exposure control portion 110.

The finisher 500 according to the present exemplary embodiment performs sheet bundle processing (i.e., booklet processing). In the present exemplary embodiment, the CPU circuit portion 150 performs control of the finisher 500 via the finisher control portion 501. Alternatively, the CPU circuit portion 150 may directly control the finisher 500.

Figure 8:
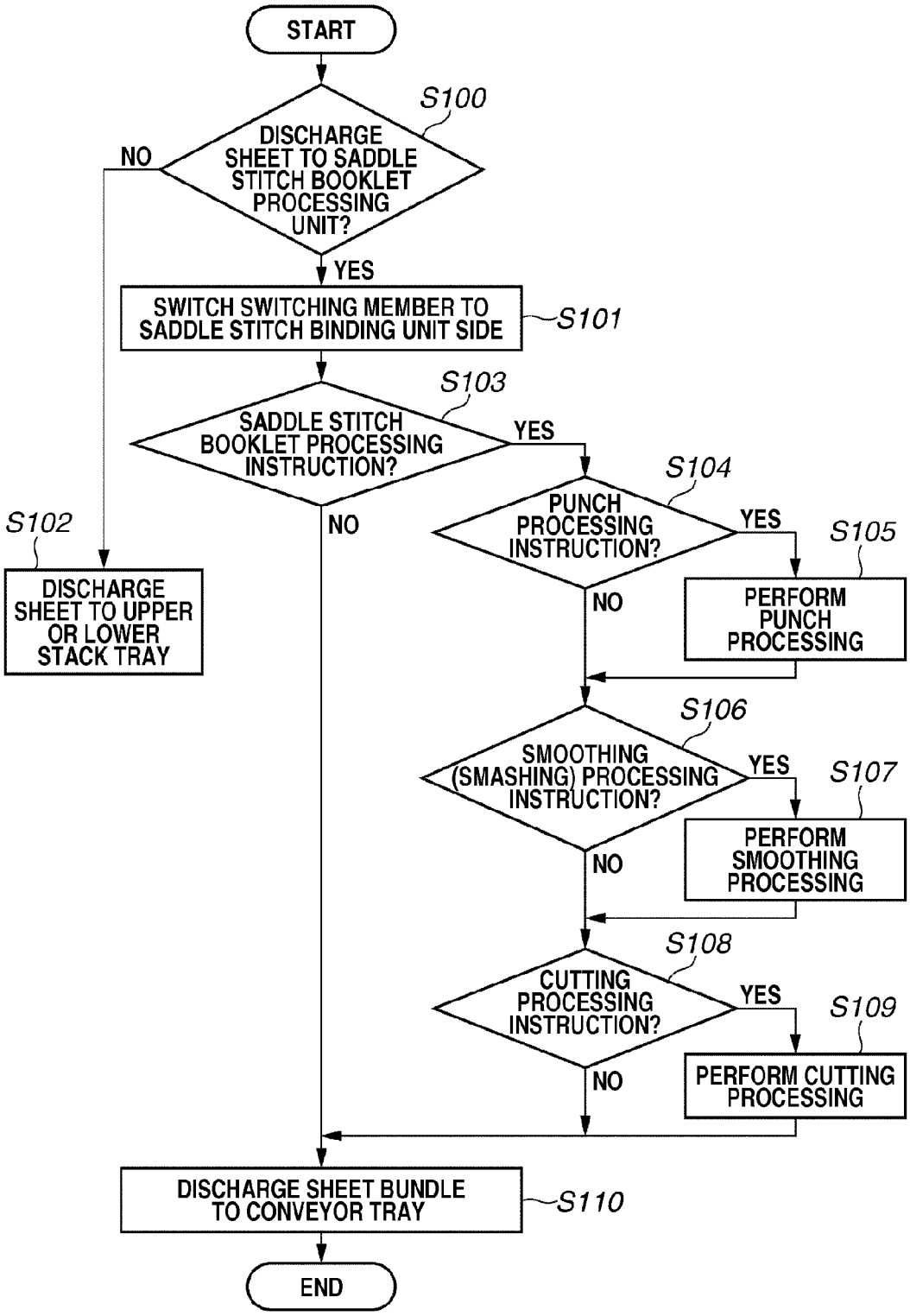
FIG. 8 is a flowchart illustrating booklet processing that can be performed by the finisher.

In step S100 of a flowchart illustrated in FIG. 8, the CPU circuit portion 150 determines whether a sheet is discharged to the saddle stitch booklet processing portion 600. If it is determined that the sheet is discharged to the saddle stitch booklet processing portion 600 (YES in step S100), then in step S101, the CPU circuit portion 150 switches the switching member 514 (see FIG. 2) to the saddle stitch binding portion side. If it is determined that the sheet is not discharged to the saddle stitch booklet processing portion 600 (NO in step S100), then in step S102, the CPU circuit portion 150 discharges the sheet to the upper stack tray 701 or the lower stack tray 700.

Subsequently, a saddle stitch sheet bundle (i.e., a booklet) is generated by the saddle stitch binding portion 800, as illustrated in FIG. 3, and is then discharged via the second folding conveyance rollers 812*a* and 812*b* to the booklet reception portion 610. Next, in step S103, the CPU circuit portion 150 determines whether the saddle stitch booklet processing is instructed. If it is determined that a saddle stitch booklet processing mode is not selected (NO in step S103), then in step S110, the CPU circuit portion 150 discharges the sheet bundle to the conveyor tray 670 via the lower conveyance belt 611, the conveyance claws 613, and the paired conveyance belts 661 and 662. In this case, the side guide pair 612, the upper holding plate 627, the cornering unit 640, and the positioning stopper 663 are in their retreat positions and do not block the conveyance path.

Figure 9:
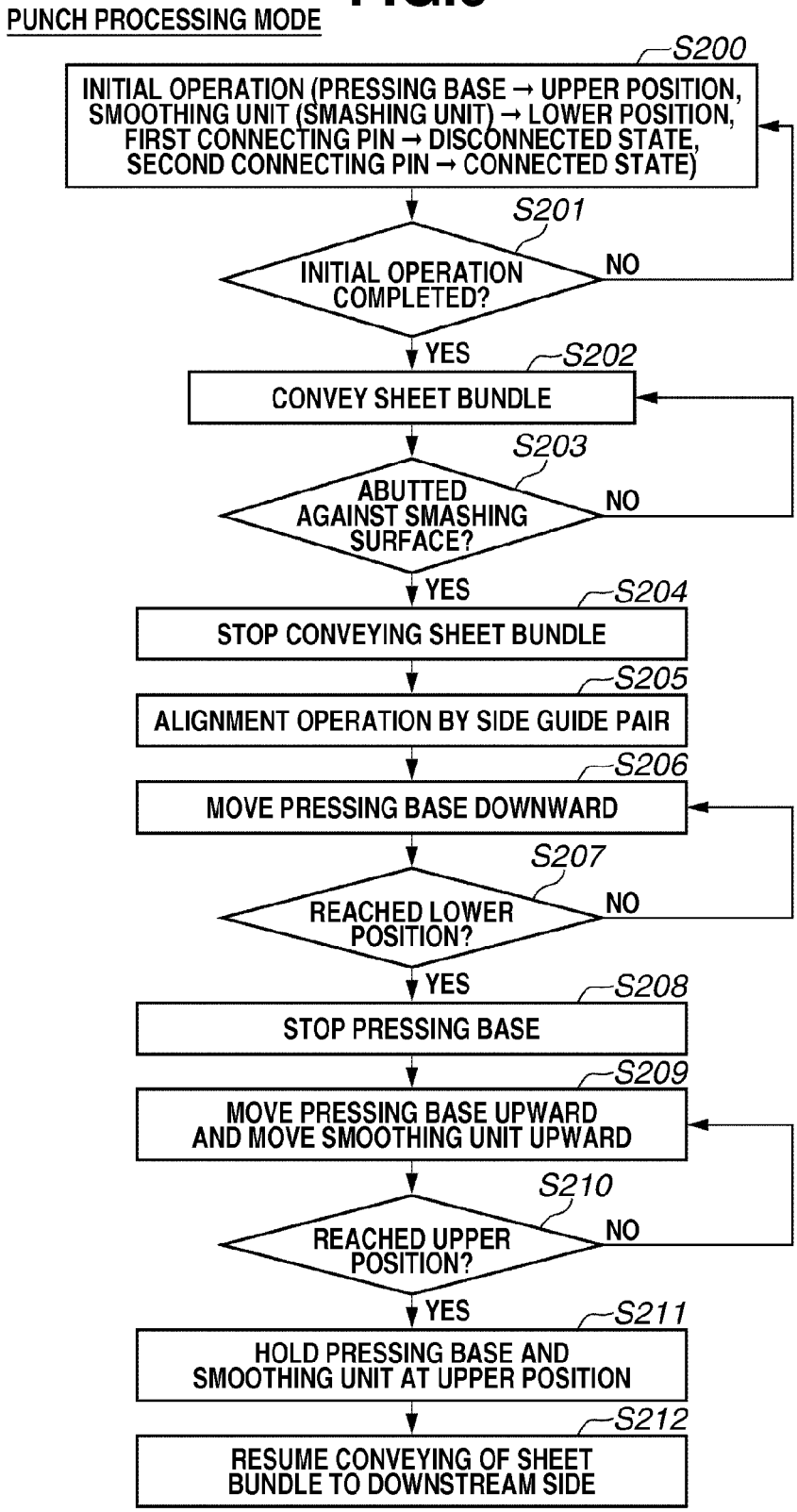
FIG. 9 is a flowchart illustrating punch processing that can be performed as part of the booklet processing.

If it is determined that the saddle stitch booklet processing mode is selected (YES in step S103), then in step S104, the CPU circuit portion 150 determines whether the punch processing is instructed. If it is determined that the punch processing is instructed (YES in step S104), namely, if a punch processing mode is selected by a user via the operation portion 1, then in step S105, the CPU circuit portion 150 performs the punch processing according to a flowchart illustrated in FIG. 9.

More specifically, in step S200, the CPU circuit portion 150 performs the following initial operation to start the punch processing. The CPU circuit portion 150 moves the holding base 626 to the upper position and moves the cornering unit 640 to the lower position before a sheet bundle SA is discharged to the booklet reception portion 610. The CPU circuit portion 150 brings the second connecting pin 631 into a connected state to engage the punch 630 with the holding base 626. The CPU circuit portion 150 brings the first connecting pin 623 into a disconnected state to disengage the upper cutting blade 621 from the holding base 626. When the cornering unit 640 reaches the lower position, the pressing member 642 blocks the conveyance path R. This position can be referred to as a standby position.

Figure 11:
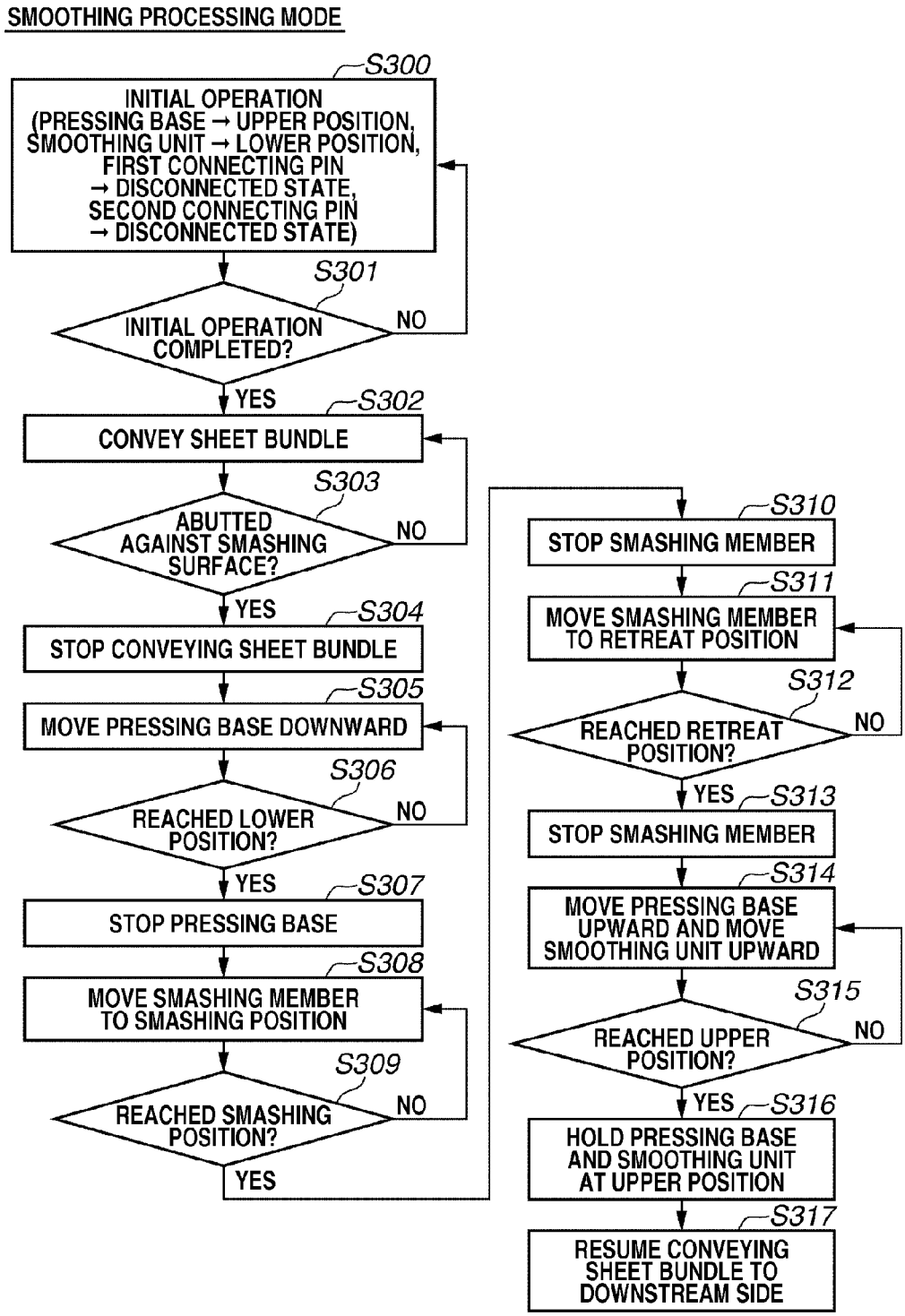
FIG. 11 is a flowchart illustrating cornering processing that can be performed as part of the booklet processing.

If it is determined that the above-described initial operation is completed (YES in step S201), then in step S202, the CPU circuit portion 150 drives the motors SM1 and SM2 to cause the lower conveyance belt 611 and the conveyance claws 613 to convey the sheet bundle SA. Then, in step S203, the CPU circuit portion 150 determines whether the folded spinal portion of the conveyed sheet bundle SA has collided against the pressing surface 641 of the pressing member 642. If it is determined that the folded spinal portion of the sheet bundle SA abuts against the pressing surface 641 as illustrated in FIG. 11A (YES in step S203), then in step S204, the CPU circuit portion 150 stops conveying the sheet bundle SA. Then, in step S205, the CPU circuit portion 150 causes the side guide pair 612 to perform a nipping operation (i.e., an alignment operation) to adjust the position of the sheet bundle SA in both the conveyance direction and the width direction.

Figure 10A:
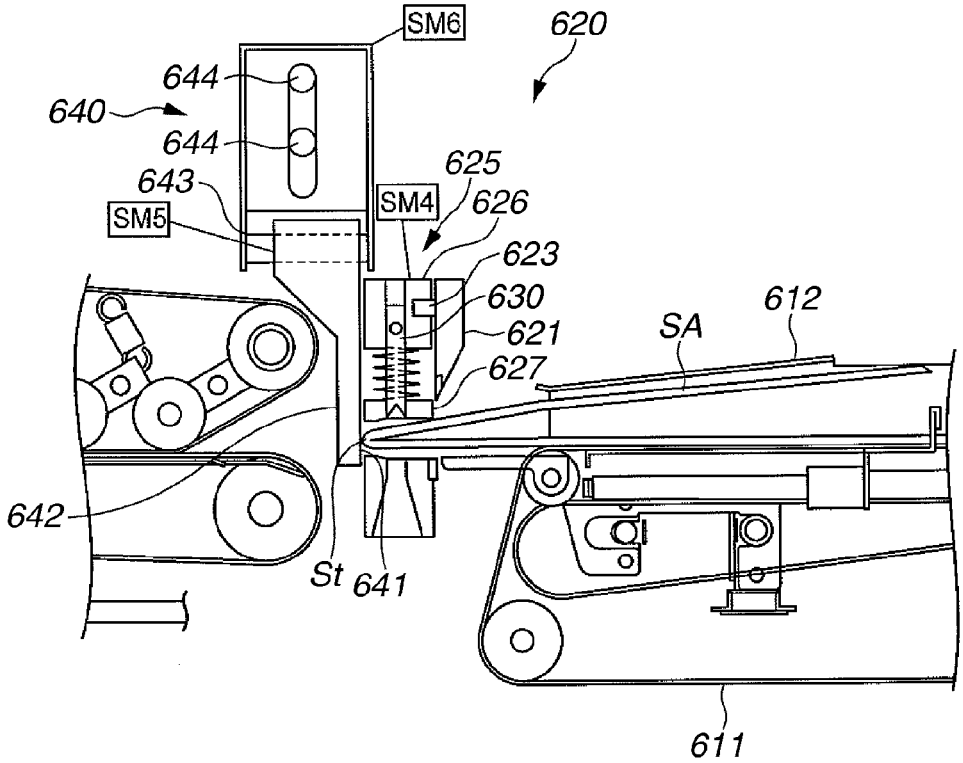
FIGS. 10A and 10B illustrate punch processing that can be performed by the booklet processing unit.
Figure 10B:
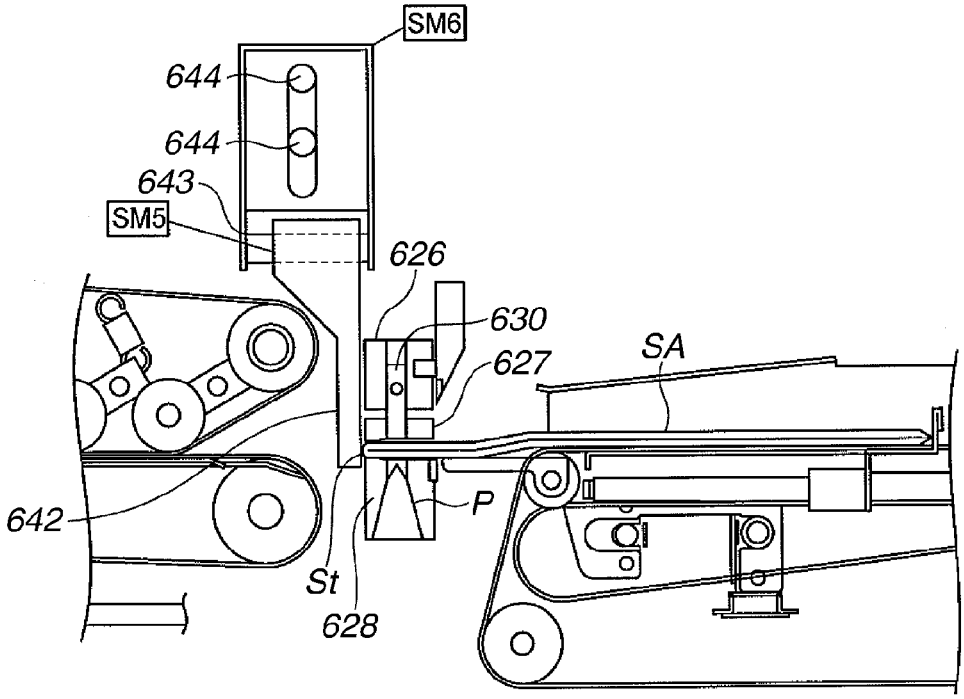

In step S206, the CPU circuit portion 150 drives the motor SM4 to move the holding base 626 downward together with the upper holding plate 627 and the punch 630 as illustrated in FIG. 10B. In the process of lowering the holding base 626, the upper holding plate 627 contacts an upper surface of the sheet bundle. Then, the holding base 626 further moves downward while compressing the compression spring 629.

In step S207, the CPU circuit portion 150 determines whether the holding base 626 has reached the lower position. If it is determined that the holding base 626 has reached the lower position (YES in step S207), then in step S208, the CPU circuit portion 150 deactivates the motor SM4 to stop the holding base 626. In a state where the holding base 626 is stopped, the sheet bundle SA is firmly clamped by the upper and lower holding plates 627 and 628.

As the punch 630 is engaged with the holding base 626, the punch 630 moves downward together with the holding base 626. The lower end of the punch 630 can shift across the sheet S into the receiving hole of the lower holding plate 628. Thus, the punch 630 opens two punch holes at predetermined positions of the sheet bundle SA. The position of the punch in the conveyance direction can be determined by the position where the pressing surface 641 stops a sheet bundle. Accordingly, to open a punch hole at a desired position, the CPU circuit portion 150 can control the motor SM5 to adjust the stop position of the pressing member 642 in the conveyance direction. The generated scrap falls into a scrap box (not illustrated) positioned below the punch 630.

Next, in step S209, the CPU circuit portion 150 drives the motor SM4 in the reverse direction to move the holding base 626 to the upper position so that the sheet bundle SA can be released from the upper holding plate 627 and the punch 630. The CPU circuit portion 150 further drives the motor SM6 in the reverse direction to move the cornering unit 640 to the upper position. In step S210, the CPU circuit portion 150 determines whether the holding base 626 and the cornering unit 640 have reached their upper positions. If it is determined that the holding base 626 and the cornering unit 640 have reached their upper positions (YES in step S210), then in step S211, the CPU circuit portion 150 deactivates the motors SM4 and SM6 to hold the holding base 626 and the cornering unit 640 at their upper positions. In step S212, the CPU circuit portion 150 drives the lower conveyance belt 611, the conveyance claws 613, and the paired conveyance belts 661 and 662 to restart conveying the sheet bundle SA. Thus, the sheet bundle SA can be conveyed to the downstream side in the conveyance direction.

Next, after completing the above-described punch processing, in step S106 of FIG. 8, the CPU circuit portion 150 determines whether the cornering process as a deforming process is instructed. If it is determined that the cornering process is instructed (YES in step S106), i.e., if a cornering process mode is selected, then in step S107, the CPU circuit portion 150 performs the cornering process according to a flowchart illustrated in FIG. 11.

More specifically, in step S300, the CPU circuit portion 150 performs the following initial operation to start the cornering process. The CPU circuit portion 150 moves the holding base 626 to the upper position and moves the cornering unit 640 to the lower position before the sheet bundle SA is discharged to the booklet reception portion 610. The CPU circuit portion 150 brings the second connecting pin 631 into a disconnected state to disengage the punch 630 from the holding base 626. The CPU circuit portion 150 brings the first connecting pin 623 into a disconnected state to disengage the upper cutting blade 621 from the holding base 626. When the cornering unit 640 reaches the lower position, the pressing member 642 reaches the standby position.

Figure 12A:
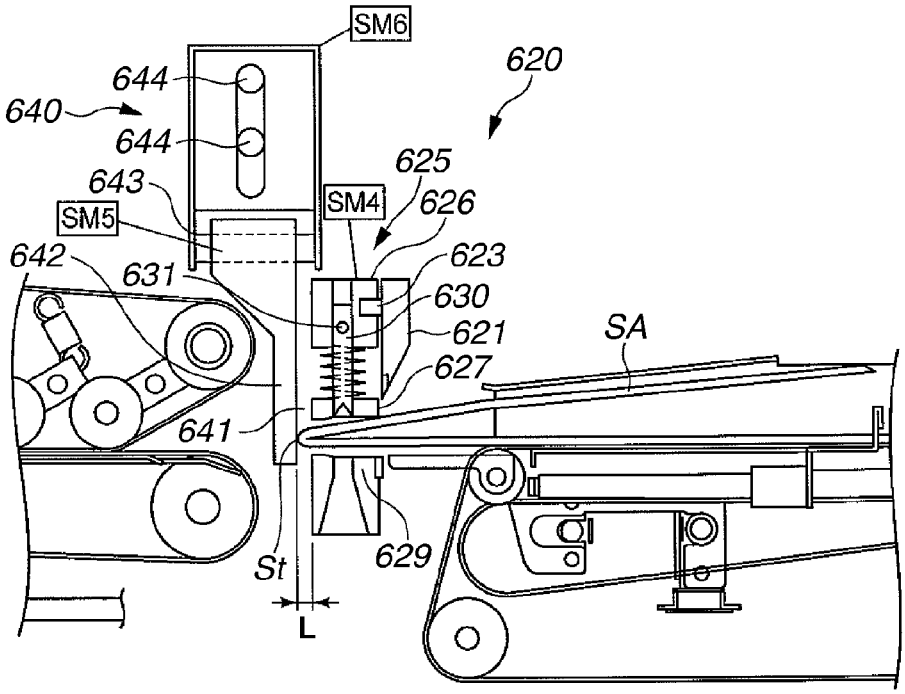
FIGS. 12A and 12B illustrate cornering processing that can be performed by the booklet processing unit.

If it is determined that the above-described initial operation is completed (YES in step S301), then in step S302, the CPU circuit portion 150 drives the motors SM1 and SM2 to cause the lower conveyance belt 611 and the conveyance claws 613 to convey the sheet bundle SA. Then, in step S303, the CPU circuit portion 150 determines whether the folded spinal portion of the conveyed sheet bundle SA has collided against the pressing surface 641 of the pressing member 642. If it is determined that the folded spinal portion of the sheet bundle SA abuts against the pressing surface 641 of the pressing member 642 as illustrated in FIG. 12A (YES in step S303), then in step S304, the CPU circuit portion 150 stops conveying the sheet bundle SA. In this case, the pressing surface 641 of the pressing member 642 is spaced from the upper and lower holding plates 627 and 628 by an amount equivalent to the distance L (i.e., a moving mount in a direction along the sheet surface in the cornering process) in the conveyance direction.

Then, in step S305, the CPU circuit portion 150 causes the side guide pair 612 to perform a nipping operation to adjust the position of the sheet bundle SA in both the conveyance direction and the width direction. Then, the CPU circuit portion 150 drives the motor SM4 to move the holding base 626 downward. In step S306, the CPU circuit portion 150 determines whether the holding base 626 has reached the lower position. If it is determined that the holding base 626 has reached the lower position (YES in step S306), then in step S307, the CPU circuit portion 150 deactivates the motor SM4 to stop the holding base 626.

Figure 12B:
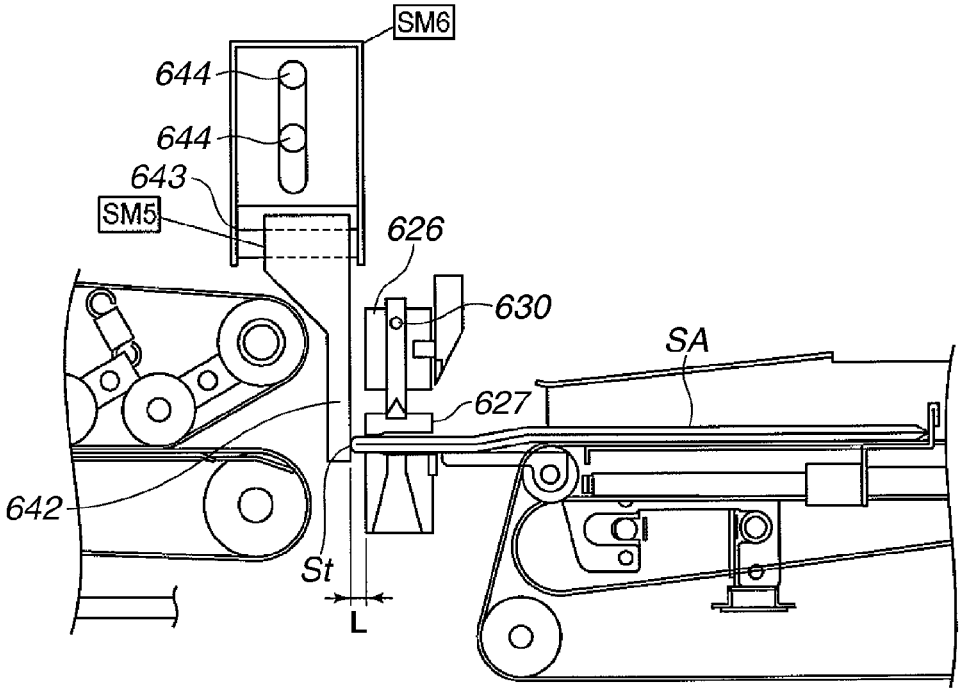

When the holding base 626 is stopped, the sheet bundle SA is clamped between the upper and lower holding plates 627 and 628 in a state where the folded spinal portion St (i.e., a folded portion) of the sheet bundle SA protrudes from the holding plates 627 and 628, as illustrated in FIG. 12B. In the state illustrated in FIG. 12B, the punching process mode is not set. Therefore, the punch 630 does not move. If the punching process mode is set, the punch 630 moves downward together with the holding base 626 to perform a punching operation for the sheet bundle SA as described above.

In step S308, the CPU circuit portion 150 drives the motor SM5 to move the pressing member 642 toward the sheet bundle (i.e., the right side in the drawing). Namely, the pressing member 642 moves from the standby position to a pressing position. Accordingly, the pressing member 642 presses the folded spinal portion St (i.e., a protruded portion) of the sheet bundle SA along the width direction of the folded spinal portion St. More specifically, the pressing member 642 moves while cornering the folded spinal portion St.

In step S309, the CPU circuit portion 150 determines whether the pressing member 642 has reached the pressing position where the pressing member 642 collides with the upper and lower holding plates 627 and 628. If it is determined that the pressing member 642 has reached the pressing position (YES in step S309), then in step S310, the CPU circuit portion 150 deactivates the motor SM5 to stop the pressing member 642. The gripping force of the upper and lower holding plates 627 and 628 can be set by the compression spring 629 that gives a sufficient force for firmly holding the sheet bundle SA even when the pressing operation is performed.

Figure 13:
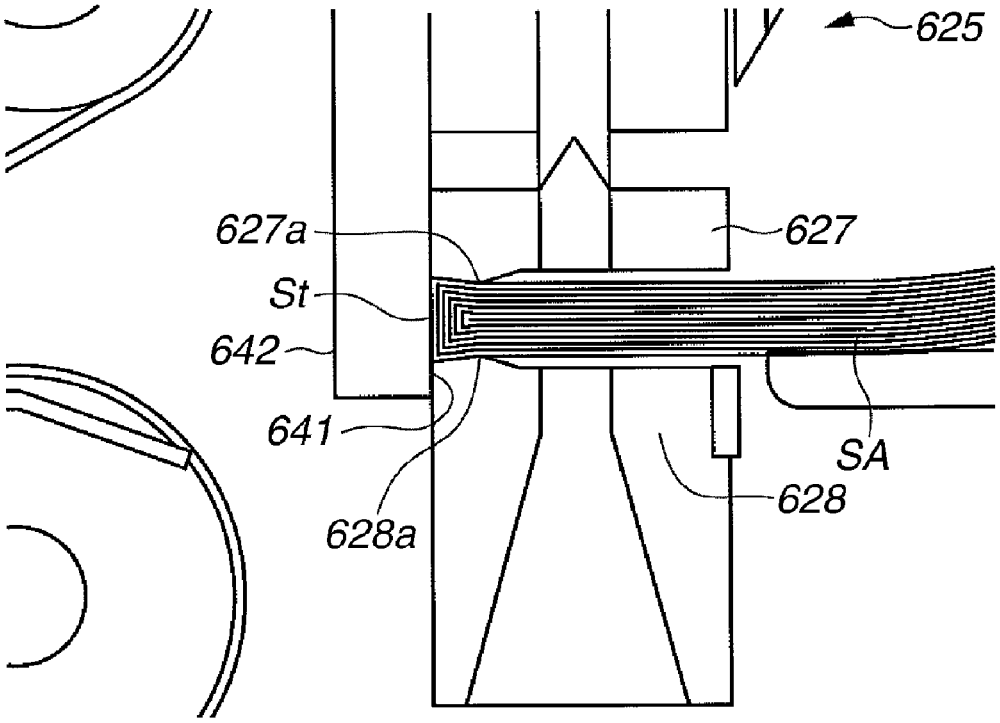
FIG. 13 illustrates a state of a folded spinal portion of a sheet bundle that has been subjected to the cornering processing.

In this manner, if the pressing member 642 moves while cornering the folded spinal portion St of the sheet bundle SA, the folded spinal portion St (i.e., a protruded portion in a curved shape) can be cornered into a square shape along the pressing surface 641 as illustrated in FIG. 13. The pressing amount of the folded spinal portion St is substantially equal to the above-described moving amount L.

In the present exemplary embodiment, the upper and lower holding plates 627 and 628 have ridges 627*a* and 628*a* formed at their front ends. The ridges 627*a* and 628*a* are effective to deform the spinal portion St of the sheet bundle SA into a square shape in cross section. The deformation occurs on the downstream side of the ridges 627*a* and 628*a* in the conveyance direction. The sheet bundle SA does not move and its shape does not deform on the upstream side of the ridges 627*a* and 628*a* in the conveyance direction. According to the above-described configuration, not only the front/back covers but also the bulk of inner sheets can be subjected to the deformation of the square shape.

Next, in step S311, the CPU circuit portion 150 drives the motor SM5 in the reverse direction to remove the pressing member 642 (more specifically, the pressing surface 641) from the folded spinal portion. The pressing member 642 moves to a retreat position illustrated in FIGS. 12A and 12B. In step S312, the CPU circuit portion 150 determines whether the pressing member 642 has reached the retreat position. If it is determined that the pressing member 642 has reached the retreat position (YES in step S312), then in step S313, the CPU circuit portion 150 deactivates the motor SM5 to stop the pressing member 642.

In step S314, the CPU circuit portion 150 drives the motor SM4 in the reverse direction to move the holding base 626 to the upper position so that the sheet bundle SA can be released from the upper holding plate 627. The CPU circuit portion 150 further drives the motor SM6 in the reverse direction to move the cornering unit 640 to the upper position. In step S315, the CPU circuit portion 150 determines whether the holding base 626 and the cornering unit 640 have reached their upper positions. If it is determined that the holding base 626 and the cornering unit 640 have reached their upper positions (YES in step S315), then in step S316, the CPU circuit portion 150 deactivates the motors SM4 and SM6 to hold the holding base 626 and the cornering unit 640 at their upper positions.

Figure 14:
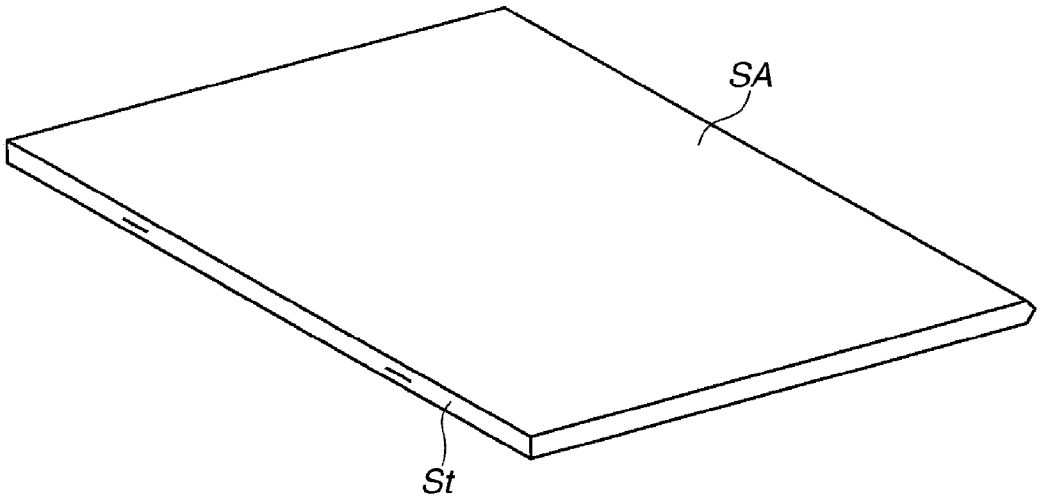
FIG. 14 is a perspective view illustrating a sheet bundle discharged after it is subjected to the above-described cornering processing.

In step S317, the CPU circuit portion 150 drives the lower conveyance belt 611, the conveyance claws 613, and the paired conveyance belts 661 and 662 to restart conveying the sheet bundle SA. Thus, the sheet bundle SA can be conveyed to the downstream side in the conveyance direction. FIG. 14 is a perspective view illustrating a sheet bundle having been subjected to the cornering process and discharged to the conveyor tray 670.

The above-described cornering process served as a deforming process uses a flat surface (i.e., the pressing surface 641 of the pressing member 642) to press a folded spinal portion. Therefore, the stress is uniformly applied to the folded spinal portion without causing any curl, scratch, or tear. When the folded spinal portion is cornered, the cornering force can be uniformly applied to the folded spinal portion in the thickness direction. Therefore, no shear stress acts between sheets. No breakage of a sheet occurs from a stapled portion.

A pressing amount required to deform all the sheets constituting a sheet bundle into a square shape increases according to the thickness of the sheet bundle. In other words, it is necessary to increase (i.e., change) the pressing amount by the pressing member 642, i.e., the moving amount L between the pressing surface 641 and the upper and lower holding plates 627 and 628, in proportion to the number of sheets constituting the sheet bundle.

Therefore, in the present exemplary embodiment, the finisher control portion 501 controls the moving amount L according to a thickness of each sheet bundle, which can be calculated by the CPU circuit portion 150 based on sheet thickness information and the number of sheets constituting the sheet bundle which are entered beforehand. With the above-described configuration, the present exemplary embodiment can set an appropriate moving amount that accords with the thickness of a sheet bundle and can adequately perform cornering process for deforming a folded spinal portion into a square shape as a deforming process.

A pressing time required to keep the shape of a folded spinal portion stably even after the cornering process is completed increases according to the rigidity (or thickness) of the sheet bundle. Therefore, in the present exemplary embodiment, the CPU circuit portion 150 can increase the time required for pressing the pressing surface 641 against the upper and lower holding plates 627 and 628 according to a calculated thickness of the sheet bundle. In this manner, the pressing time by the pressing member 642 can be increased in proportion to the number of sheets constituting a sheet bundle. Therefore, the present exemplary embodiment can firmly corner and smooth the folded spinal portion having a curved shape. In the present exemplary embodiment, the CPU circuit portion 150 can calculate the thickness of a sheet bundle based on input information. However, a bundle thickness detection portion (e.g., a displacement sensor) may be provided. The CPU circuit portion 150 may control the moving amount L based on thickness information obtained by the bundle thickness detection portion.

In the present exemplary embodiment, the pressing surface 641 serves as a surface not only for adjusting the position of the sheet bundle SA but also applying the cornering force. Therefore, the present exemplary embodiment can reduce differences in the moving amount (i.e., pressing amount) L. As a result, the present exemplary embodiment can reduce differences in the square shape of respective folded spinal portions of two or more sheet bundles that are cornered together. The present exemplary embodiment can stably process each sheet bundle into a desired shape.

Figure 15:
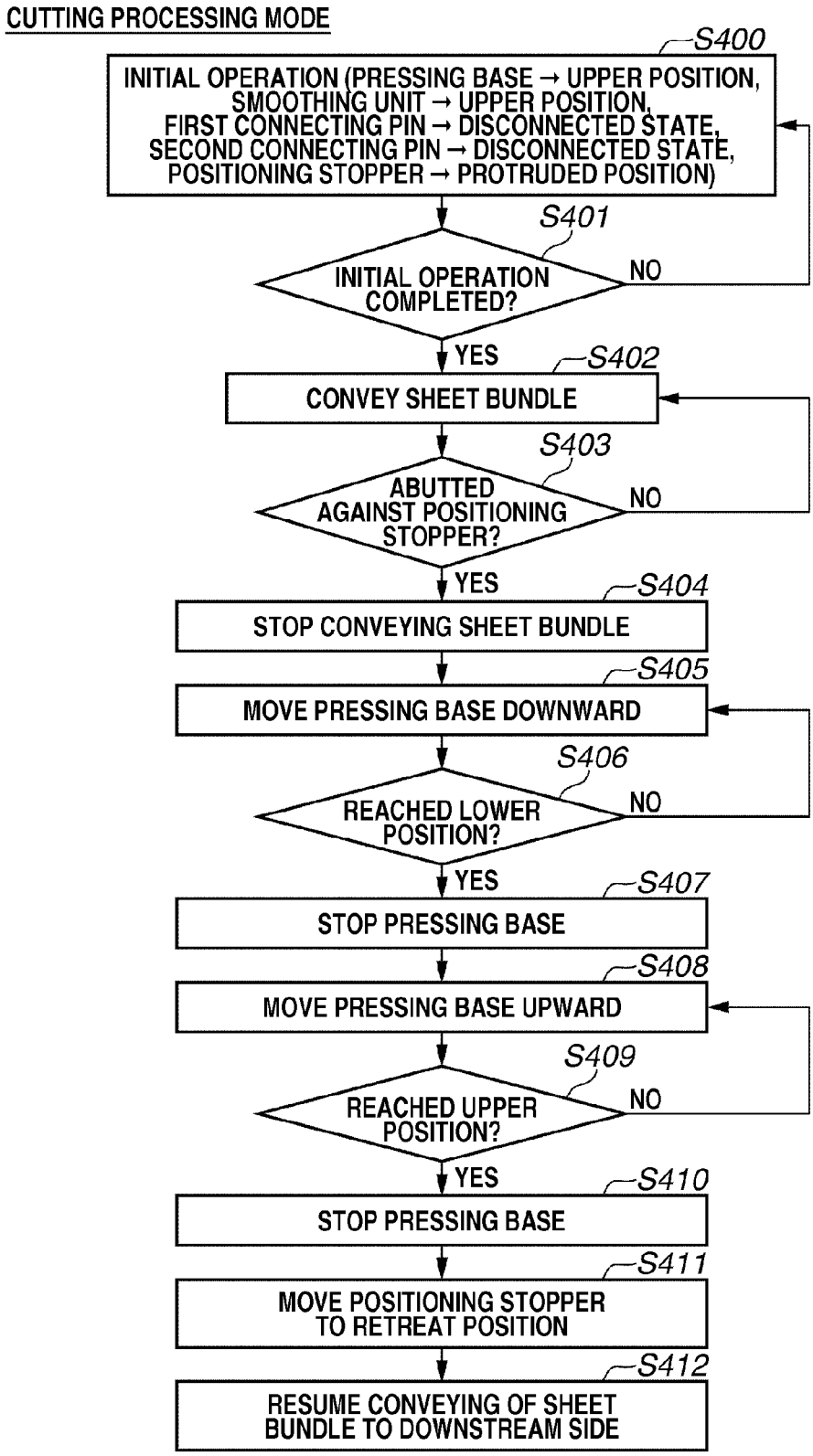
FIG. 15 is a flowchart illustrating cutting processing that can be performed as part of the booklet processing.

After the above-described punching process and the cornering process are selectively performed according to the setting modes, the CPU circuit portion 150 resumes the process of the flowchart illustrated in FIG. 8. More specifically, in step S108, the CPU circuit portion 150 determines whether the cutting process is instructed. If it is determined that the cutting process is instructed (YES in step S108), i.e., if a cutting process mode is selected, then in step S109, the CPU circuit portion 150 performs the cutting process according to a flowchart illustrated in FIG. 15.

More specifically, in step S400, the CPU circuit portion 150 performs the following initial operation to start the cutting process. The CPU circuit portion 150 moves the holding base 626 to the upper position and moves the cornering unit 640 to the upper position before the sheet bundle SA is discharged to the booklet reception portion 610. The CPU circuit portion 150 brings the second connecting pin 631 into a disconnected state to disengage the punch 630 from the holding base 626. The CPU circuit portion 150 brings the first connecting pin 623 into a disconnected state to disengage the upper cutting blade 621 from the holding base 626. Moreover, the CPU circuit portion 150 causes the positioning stopper 663 of the bundle conveyance portion 660 to protrude from the conveyance path at a position corresponding to the size of the conveyed sheet bundle SA.

Figure 16:
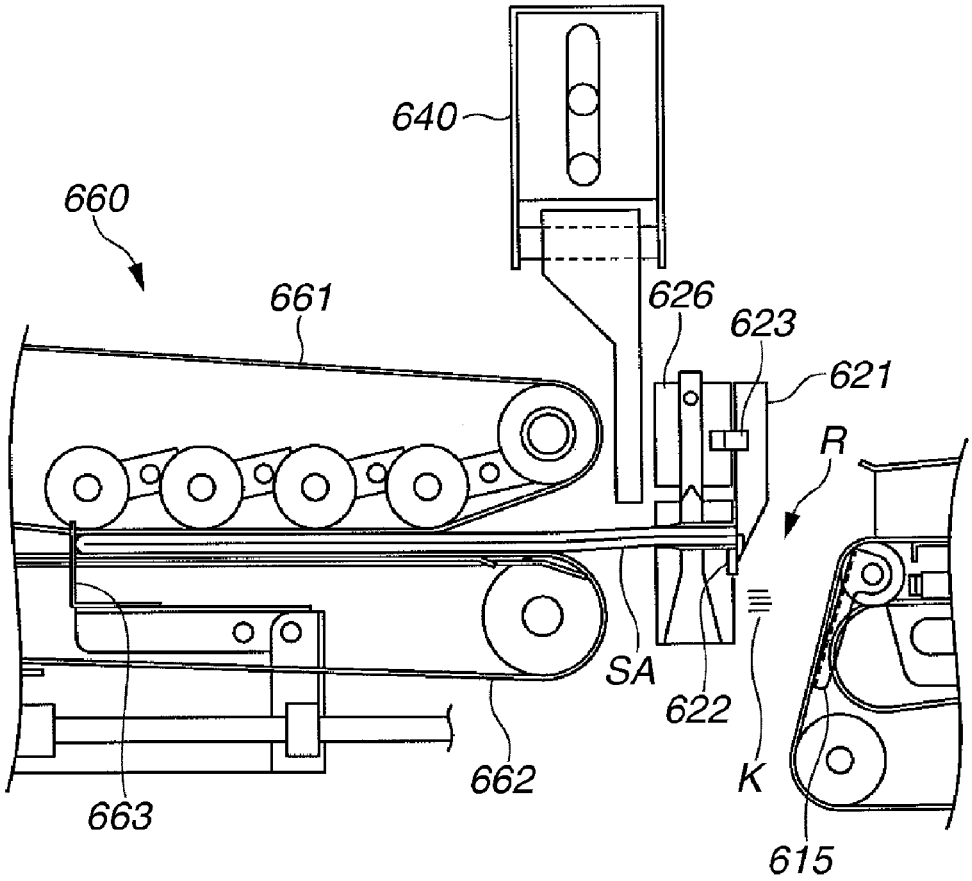
FIG. 16 illustrates cutting processing that can be performed by the booklet processing unit.

If it is determined that the above-described initial operation is completed (YES in step S401), then in step S402, the CPU circuit portion 150 drives the motors SM1 and SM2 to cause the lower conveyance belt 611 and the conveyance claws 613 to convey the sheet bundle SA. Then, in step S403, the CPU circuit portion 150 determines whether the folded spinal portion of the conveyed sheet bundle SA has collided against the positioning stopper 663 as illustrated in FIG. 16. If it is determined that the folded spinal portion of the conveyed sheet bundle SA abuts against the positioning stopper 663 (YES in step S403), then in step 404, the CPU circuit portion 150 stops conveying the sheet bundle SA.

In step S405, the CPU circuit portion 150 brings the first connecting pin 623 into a connected state to engage the upper cutting blade 621 with the holding base 626. The CPU circuit portion 150 further drives the motor SM4 to move the holding base 626 downward. If the holding base 626 has reached the lower position (YES in step S406), then in step S407, the CPU circuit portion 150 deactivates the motor SM4 to stop the holding base 626.

If the holding base 626 moves downward, the upper cutting blade 621 moves together with the lowering holding base 626. Then, the upper cutting blade 621 and the lower cutting blade 622 cooperatively cut a rear end (i.e., opened end) portion of the sheet bundle SA in the conveyance direction. In this manner, when the rear edge portion of the sheet bundle SA in the conveyance direction is cut, the shutter guide 615 rotates downward in synchronization with a movement of the upper cutting blade 621 by the cam (not illustrated) fixed to the upper cutting blade 621, as described above. Thus, the scrap K illustrated in FIG. 16 (i.e., the rear edge part of the sheet bundle SA having been cut) falls into a scrap box (not illustrated) positioned below the shutter guide 615.

In step S408, the CPU circuit portion 150 drives the motor SM4 in the reverse direction to move the holding base 626 upward. If it is determined that the holding base 626 has reached the upper position (YES in step S409), then in step S410, the CPU circuit portion 150 deactivates the motor SM4 to stop the holding base 626 at the upper position. In step S411, the CPU circuit portion 150 moves the positioning stopper 663 to the retreat position below the conveyance path. In step S412, the CPU circuit portion 150 drives the lower conveyance belt 611, the conveyance claws 613, and the paired conveyance belts 661 and 662 to restart conveying the sheet bundle SA. Thus, the sheet bundle SA can be conveyed to the downstream side in the conveyance direction. Then, in step S110, the CPU circuit portion 150 discharges the sheet bundle SA to the conveyor tray 670. As described above, the apparatus according to the present exemplary embodiment can process a sheet bundle as requested by an operator.

In the cutting process, to control the position of the positioning stopper 663 in the conveyance direction, the CPU circuit portion 150 controls an output pulse of the stopper moving motor SM8 based on a signal of a home position sensor, a sheet bundle size, a set cutting amount, and the pressing amount L. The CPU circuit portion 150 performs the control so as to satisfy a relationship A=B−C−L, wherein "A" represents a distance from the positioning stopper 663 to the upper and lower cutting blades 621 and 622 when the folded sheet bundle SA2 is cut, "B" represents the length of the sheet bundle SA that can be generated by the saddle stitch binding portion 800, "C" represents the cutting amount, and "L" represents the pressing amount by the cornering unit 640. Namely, to secure the constant cutting amount C, the distance "A" from the folded spinal portion of the folded sheet bundle SA2 having been subjected to the cornering process to the cutting position is set to be shorter than the distance B from the folded spinal portion of the folded sheet bundle SA1 not subjected to the cornering process to the cutting position.

When the position of the positioning stopper 663 is controlled as described above, the cutting process can be accurately performed according to a cutting amount set by an operator, irrespective of the presence of a cornering process setting or a change in the pressing (moving) amount L in the cornering process. The above-described saddle stitch booklet processing modes can be freely combined.

As described above, in the present exemplary embodiment, the pressing member 642 pressings and corners a folded spinal portion of a sheet bundle held in a protruded state in a direction along a surface of a sheet bundle held by the holding unit 625. Thus, the present exemplary embodiment uses a flat plane to pressing the folded spinal portion. The present exemplary embodiment can prevent the pressing force from excessively acting partially on an angled edge portion of the sheet bundle. The present exemplary embodiment can eliminate the shearing stress that may act between the cover sheet and inner sheets. Thus, the present exemplary embodiment can appropriately corner the folded spinal portion without damaging (e.g., curling or scratching) the sheet bundle and without tearing the cover sheet during the process.

In the present exemplary embodiment, the pressing member 642 moves in the direction along the surface of a sheet bundle held by the holding unit 625 to corner a curved front end (i.e., folded portion) of the sheet bundle. Alternatively, the holding unit 625 can be configured to move in the direction along the surface of the sheet bundle SA that is held by holding unit 625 to perform the cornering process adequately. Moreover, both the pressing member 642 and the holding unit 625 can be configured to move in the direction to approach each other along the sheet bundle surface to perform the cornering process adequately. When both the pressing member 642 and the holding unit 625 are movable, the pressing force can be increased and the processing time can be reduced.

Instead of allowing the pressing member 642 to move in the direction along the surface of a sheet bundle, it may be useful to configure the pressing member 642 to rotate freely. In this case, the pressing member 642 rotates upward when a sheet bundle is conveyed. On the other hand, when a folded spinal portion is pressed and cornered, the pressing member 642 rotates downward and collides against the front end of a sheet bundle to stop the sheet bundle. Then, the pressing member 642 corners the folded spinal portion while it rotates in the front end direction of the sheet bundle.

A second exemplary embodiment of the present invention is described below.

Figure 17:
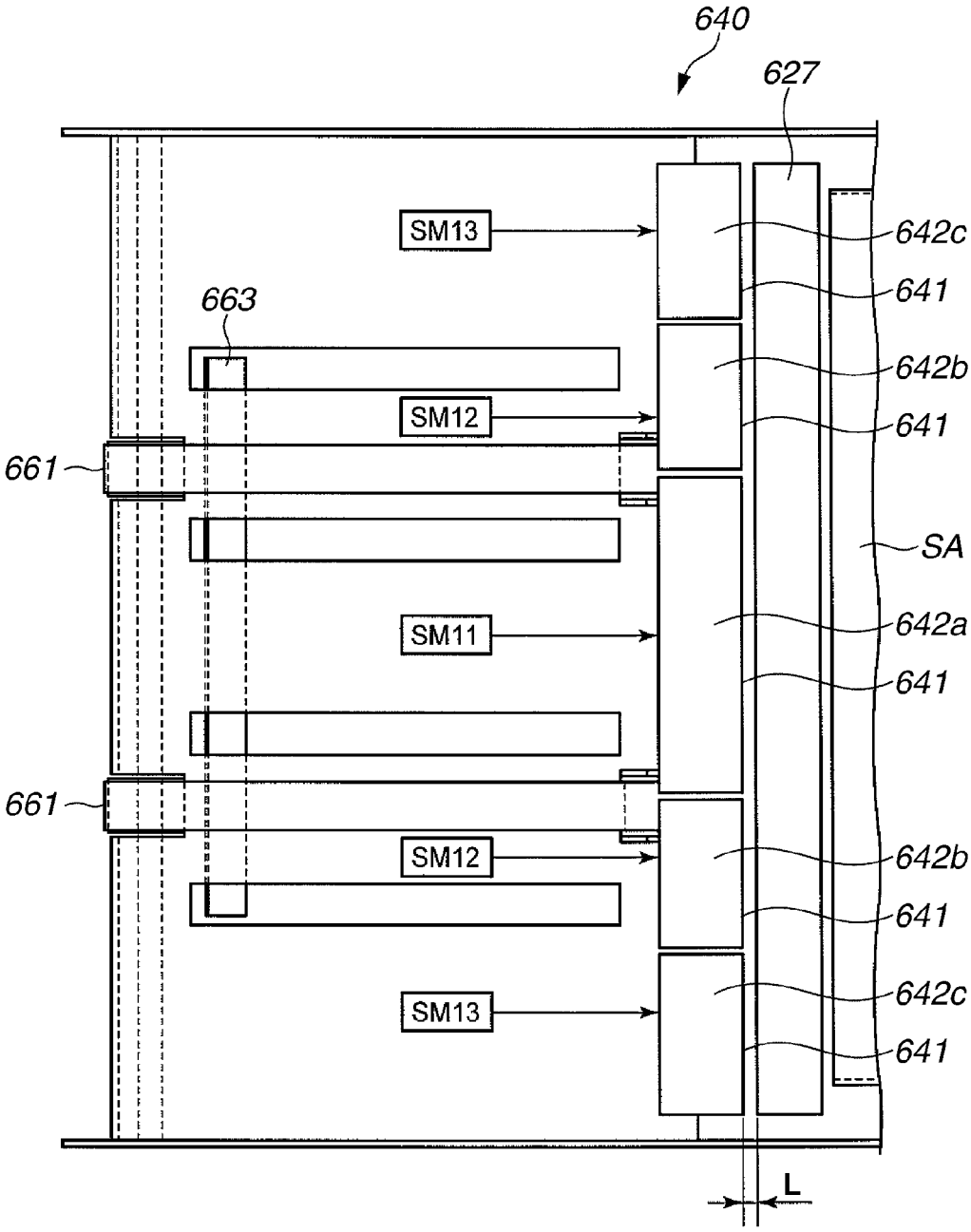
FIG. 17 illustrates a configuration of a cornering unit of a sheet processing apparatus according to a second exemplary embodiment of the present invention.

FIG. 17 illustrates a configuration of the cornering unit 640 of the sheet processing apparatus according to the second exemplary embodiment. In FIG. 17, reference numerals similar to those in FIG. 6 denote the same or corresponding portions. In the present exemplary embodiment, the pressing member 642 is divided into a plurality of (e.g., five) parts aligned in a direction parallel to a folding line of a folded spinal portion.

In the above-described cornering mode, if a curved folded spinal portion of a sheet bundle is entirely cornered and smoothed, the pressing force acting on the pressing member 642 is very large. Therefore, to overcome the pressing force, it is necessary to increase the gripping force of the upper and lower holding plates 627 and 628 that prevent the sheet bundle from moving. The driving motors SM5 and SM4 for these plates 627 and 628 are required to generate a sufficiently large output.

On the other hand, according to the present exemplary embodiment, the gripping force of the upper and lower holding plates 627 and 628 can be reduced because the pressing member 642 is divided into the plurality of parts aligned in a direction parallel to the folding line of the folded spinal portion. The output of respective motors SM5 and SM4 required to drive the plates 627 and 628 can be reduced.

In the present exemplary embodiment, as illustrated in FIG. 17, five parts of the pressing member 642 are symmetrically disposed along a line extending in the width direction parallel to the folding line of the folded spinal portion. More specifically, a first pressing member 642*a* is positioned on the center. Two second pressing members 642*b* are disposed outside the first pressing member 642*a*. Two third pressing members 642*c* are disposed outside the first pressing member 642*a*. A motor SM11 can drive the first pressing member 642*a*. Motors SM12 can drive the two second pressing members 642*b*, respectively. Motors SM13 can drive the two third pressing members 642*c*, respectively. The first to third members 642*a* to 642*c* are movable in the direction of the upper and lower holding plates 627 and 628. Each of the first to third pressing members 642*a* to 642*c* (i.e., a plurality of separated pressing members) has a flat pressing surface 641 capable of cornering a folded spinal portion of a sheet bundle being positioned.

The first pressing member 642*a* is symmetrically disposed about the central line extending in the conveyance direction. Two second pressing members 642*b* and the third pressing members 642*c* are also symmetrically disposed about the central line. The length of the first pressing member 642*a* in the width direction that can collide against the folded spinal portion is equivalent to the total length of two second pressing members 642*b* in the width direction and is equivalent to the total length of two third pressing members 642*c* in the width direction.

In the present exemplary embodiment, the folded spinal portion St of the sheet bundle Sa is cornered in the following manner. First, the first pressing member 642*a* moves in a predetermined direction to corner the folded spinal portion St. Then, the second pressing members 642*b* follow the first pressing member 642*a*. Further, the third pressing members 642*c* follow the second pressing members 642*b*. Namely, the first to third pressing members 642*a* to 642*c* successively push the folded spinal portion St from the center to the outer side of the folded spinal portion St in the width direction (i.e., in the direction along the folding line).

The cornering unit 640 performs a cornering operation in the following manner.

When the cornering mode is set, the pressing surface 641 of the first to third pressing members 642*a* to 642*c* stays at a standby position spaced by the distance L from the holding plates 627 and 628, as illustrated in FIG. 17. The folded spinal portion St of the sheet bundle SA collides against the pressing surface 641. Namely, the sheet bundle SA is positioned by the pressing surface 641. Then, the upper holding plate 627 moves downward and firmly holds the sheet bundle SA together with the lower holding plate 628.

Figure 18B:
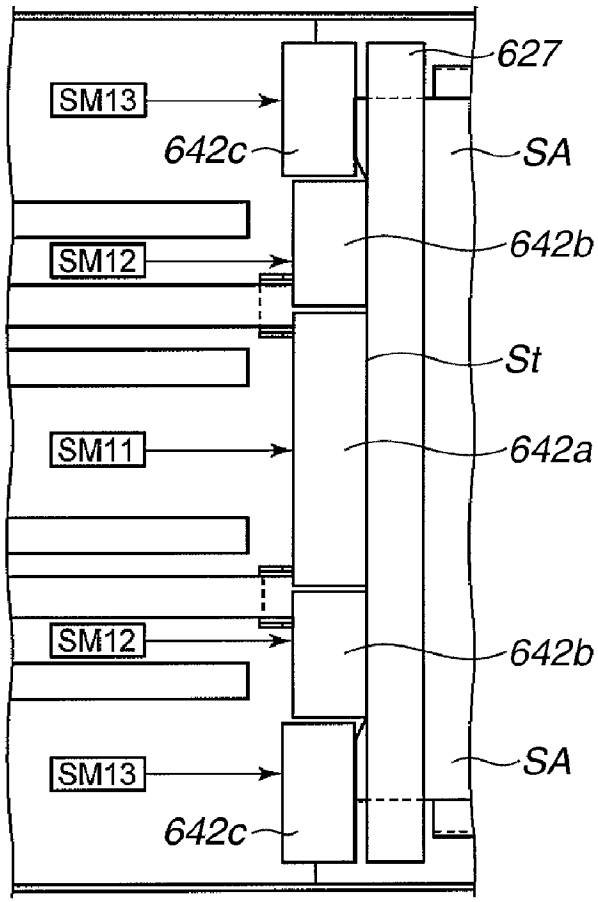
FIGS. 18A and 18B illustrate cornering processing that can be performed by the booklet processing unit.
Figure 18A:
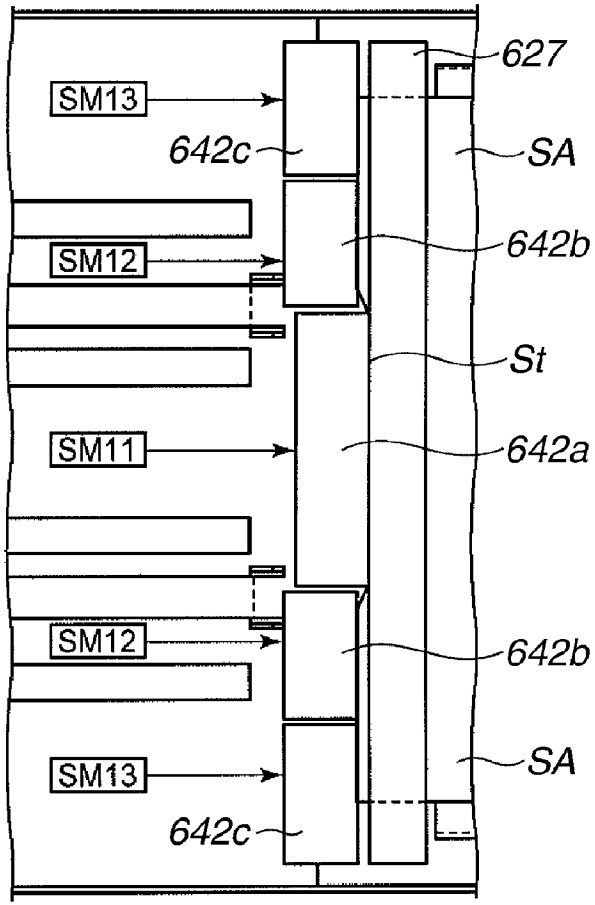

In a state where the sheet bundle SA is held in this manner, the motor SM11 drives the first pressing member 642*a* to corner its abutting region of the folded spinal portion St. The first pressing member 642*a* stops when it collides against the upper and lower holding plates 627 and 628 as illustrated in FIG. 18A.

Figure 19:
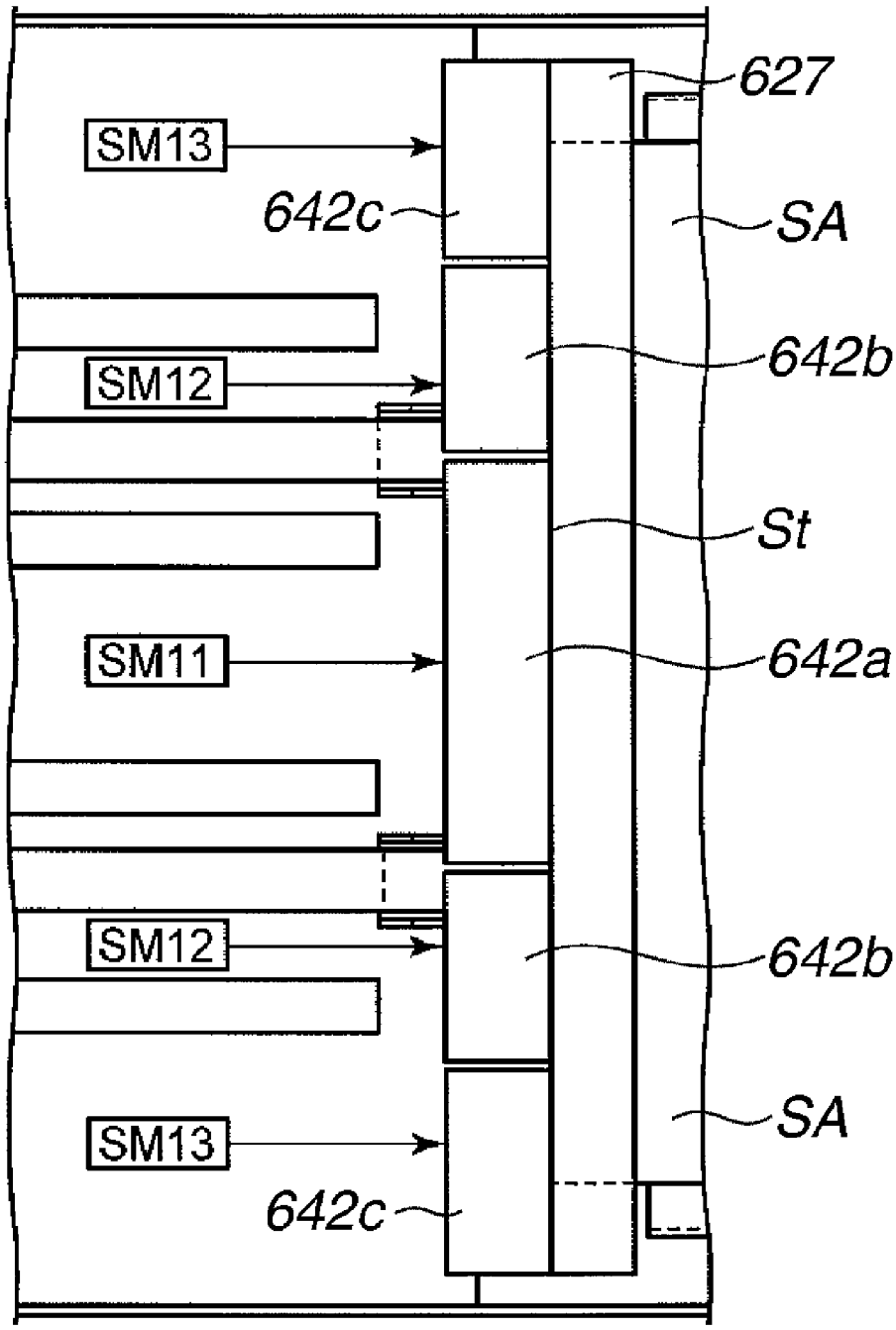
FIG. 19 illustrates cornering processing that can be performed by the booklet processing unit.

Next, the motors SM12 drive the second pressing members 642*b* to corner their abutting regions of the folded spinal portion St. The second pressing members 642*b* stop when they collide against the upper and lower holding plates 627 and 628 as illustrated in FIG. 18B. Then, the motors SM13 drive the third pressing members 642*c* to corner their a butting regions of the folded spinal portion St. The third pressing members 642*c* stop when they collide against the upper and lower holding plates 627 and 628 as illustrated in FIG. 19.

As described above, in the present exemplary embodiment, the first to third pressing members 642*a* to 642*c* successively push the folded spinal portion St symmetrically from the center to each side. Therefore, no rotational force acts on the sheet bundle SA. The folded spinal portion St can be surely cornered. When the folded spinal portion St is cornered, the boundary between a cornered region and a non-cornered region moves from the center to the outside. Therefore, no wrinkle appears on the folded spinal portion St.

As described above, the present exemplary embodiment divides the pressing member 642 into the first to third pressing members 642*a* to 642*c*. Only a part of the folded spinal portion is cornered by the separated pressing members. The force required for a pressing operation can be reduced compared to a case where the entire region is cornered simultaneously. Therefore, the present exemplary embodiment can reduce the gripping force of the upper and lower holding plates 627 and 628 required to hold a sheet bundle in the pressing operation. Accordingly, each of the motors SM4, SM11, SM12, and SM13 can be a small motor generating a small output. The present exemplary embodiment does not require higher rigidity for constituent parts of the saddle stitch booklet processing portion 600.

In the present exemplary embodiment, the folded spinal portion may not be firmly cornered at regions corresponding to clearances between the separated pressing members 642*a* to 642*c*. In this case, it is useful to allow the cornering unit 640 and the sheet bundle to relatively move in the width direction (i.e., the direction along the folding line of the folded spinal portion) to eliminate the non-cornered regions.

A third exemplary embodiment of the present invention allows the cornering unit 640 and a sheet bundle to relatively move in the width direction of the folded spinal portion.

Figure 20:
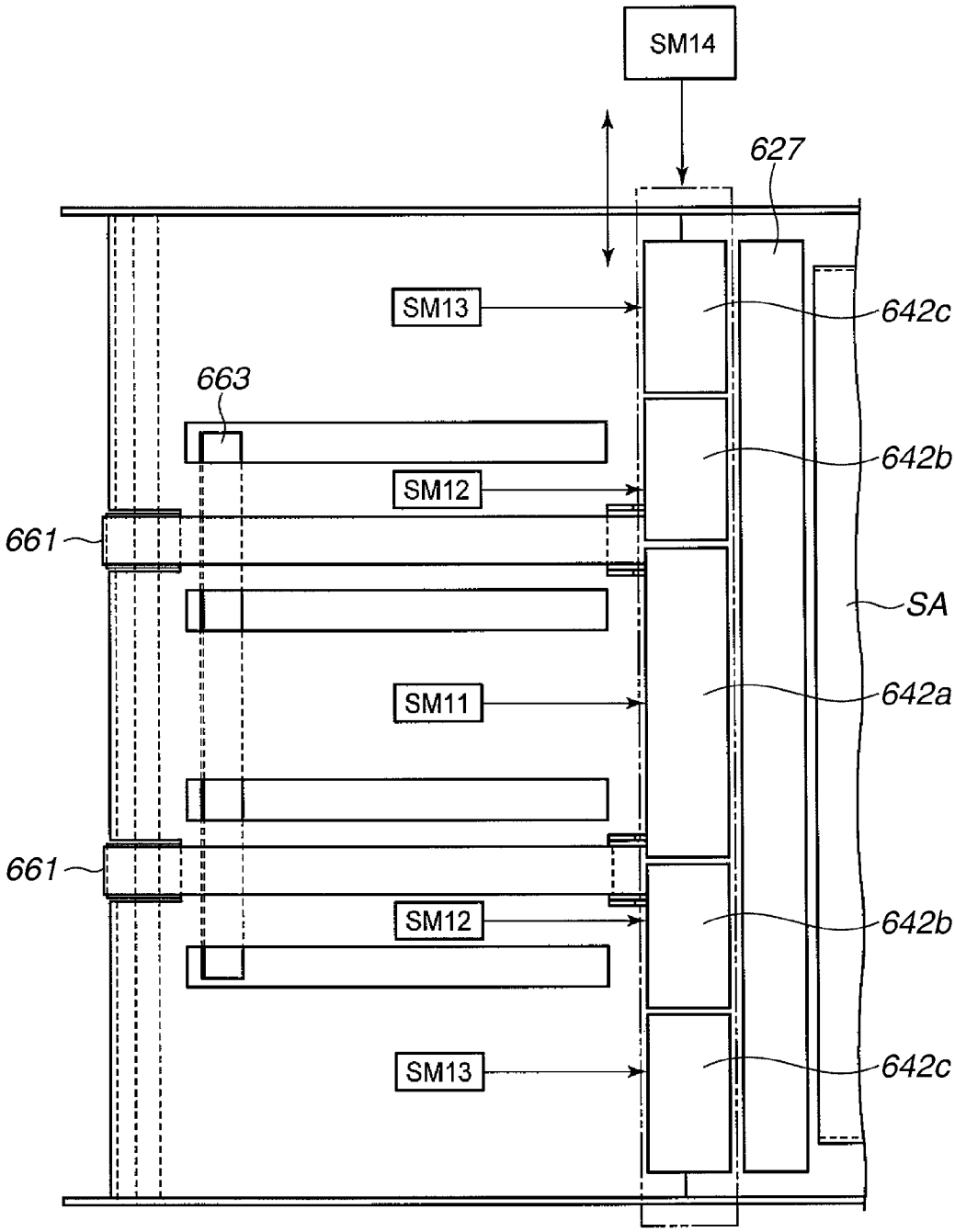
FIG. 20 illustrates a configuration of a cornering unit of a sheet processing apparatus according to a third exemplary embodiment of the present invention.

FIG. 20 illustrates a configuration of the cornering unit 640 of the sheet processing apparatus according to the third exemplary embodiment. In FIG. 20, reference numerals similar to those in FIG. 17 denote the same or corresponding portions.

In FIG. 20, a shifting motor SM14 is a motor capable of moving either the cornering unit 640 (i.e., pressing member 642) or a sheet bundle. In the present exemplary embodiment, the shifting motor SM14 moves the cornering unit 640 in the width direction of a folded spinal portion St.

Figure 21A:
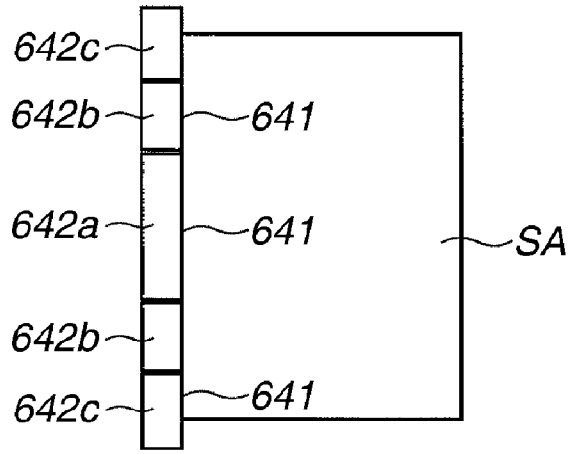
FIGS. 21A, 21B, and 21C illustrate cornering processing that can be performed by the booklet processing unit.

In the cornering unit 640, if the cornering mode is set, the pressing surface 641 of the first to third pressing members 642*a* to 642*c* stays at the standby position spaced from the holding plates 627 and 628 as illustrated in FIG. 17. The folded spinal portion of the sheet bundle SA collides against the pressing surface 641 as illustrated in FIG. 21A. Namely, the sheet bundle SA is positioned by the pressing surface 641.

Figure 21B:
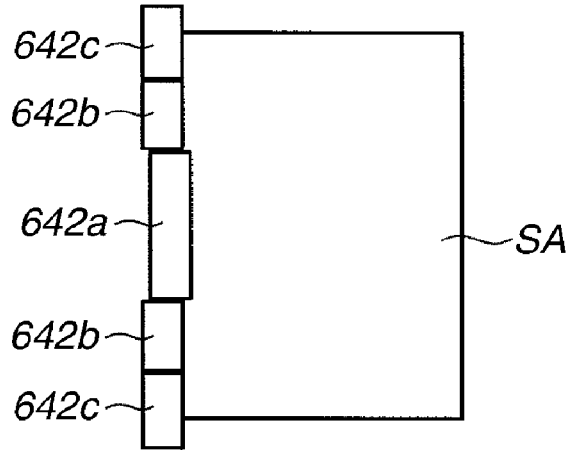
Figure 21C:
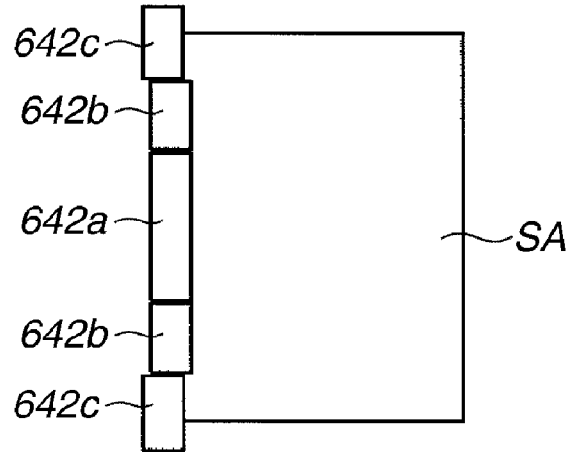
Figure 22A:
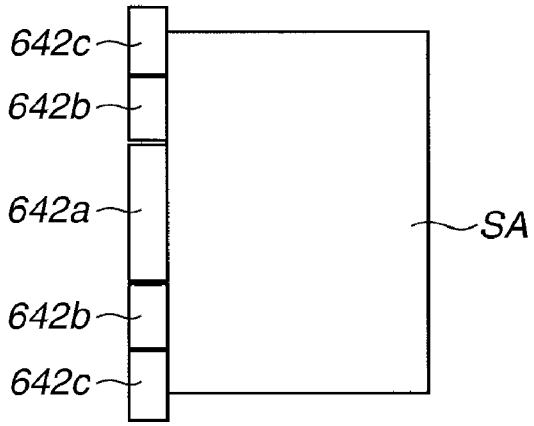
FIGS. 22A, 22B, and 22C illustrate cornering processing that can be performed by the booklet processing unit.

Next, the upper holding plate moves downward and holds the sheet bundle SA. The motor SM11 drives the first pressing member 642*a* to corner its confronting region of the folded spinal portion. The first pressing member 642*a* stops when it collides against the upper and lower holding plates, as illustrated in FIG. 21B. Then, the motors SM12 drive the second pressing members 642*b* to corner their confronting regions of the folded spinal portion. The second pressing members 642*b* stop when they collide against the upper and lower holding plates, as illustrated in FIG. 21C. Then, the motors SM13 drive the third pressing members 642*c* to corner their confronting regions of the folded spinal portion. The third pressing members 642*c* stop when they collide against the upper and lower holding plates, as illustrated in FIG. 22A.

Figure 22B:
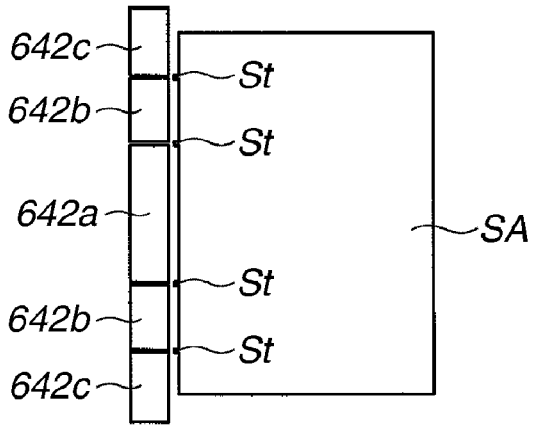

After the folded spinal portion is cornered by the first to third pressing members 642*a* to 642*c*, the first to third pressing members 642*a* to 642*c* move back to a retreat position spaced from the sheet bundle SA, as illustrated in FIG. 22B. In this state, the folded spinal portion St includes non-cornered regions at positions corresponding to the clearances of the first to third pressing members 642*a* to 642*c*, as illustrated in FIG. 22B.

Figure 22C:
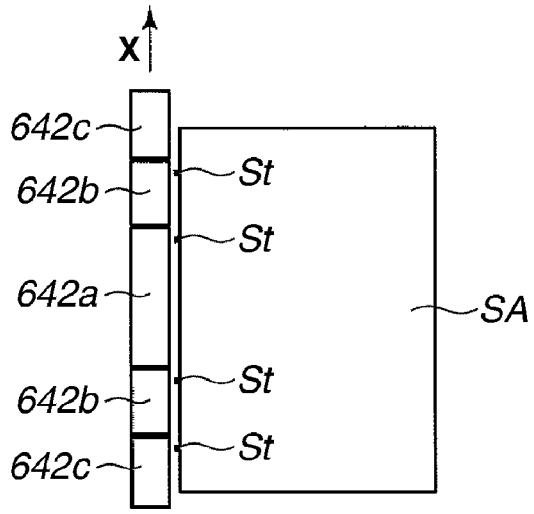

Therefore, the shifting motor SM14 moves the cornering unit 640 in a direction indicated by an arrow X in FIG. 22C by an amount equivalent to at least the clearance (+α) between the first to third pressing members 642*a* to 642*c*. When the cornering unit 640 is moved in this manner, the first to third pressing members 642*a* to 642*c* can shift to the positions where the first to third pressing members 642*a* to 642*c* can face the non-cornered regions of the folded spinal portion St of the sheet bundle.

Figure 23A:
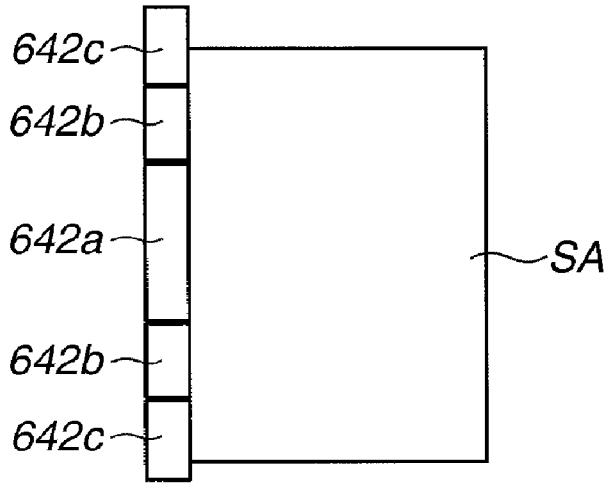
FIGS. 23A and 23B illustrate cornering processing that can be performed by the booklet processing unit.
Figure 23B:
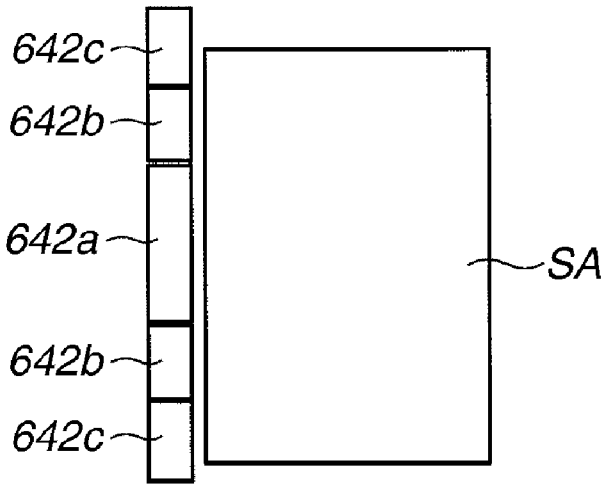

Next, in this state, the motors SM11 to SM13 simultaneously drive the first to third pressing members 642*a* to 642*c* to press the non-cornered regions of folded spinal portion St. The first to third pressing members 642*a* to 642*c* stop when they collide against the upper and lower holding plates, as illustrated in FIG. 23A.

As described above, in the present exemplary embodiment, the shifting motor SM14 moves the cornering unit 640 in the width direction after the first cornering process applied to a curved folded spinal portion is finished. Then, the motors SM11 to SM13 move the first to third pressing members 642*a* to 642*c* toward the holding plates. Namely, the motors SM11 to SM13 move the first to third pressing members 642*a* to 642*c* in a direction opposed to the pressing direction after the first pressing operation applied to the folded spinal portion is finished. Then, in a state where the cornering unit 640 is shifted slightly in the width direction, the first to third pressing members 642*a* to 642*c* perform a second pressing operation for the non-cornered regions of the folded spinal portion. Therefore, the curved folded spinal portion can be completely cornered.

The present exemplary embodiment moves the cornering unit 640 toward the folded spinal portion of the sheet bundle SA to cause the non-cornered regions of the folded spinal portion St of the sheet bundle SA to face the pressing members 642*a* to 642*c*. Alternatively, the sheet bundle SA can be moved. To this end, the holding unit 625 may have a shifting portion. The side guide pair 612 can be configured to operate independently so as to serve as a shifting portion to move only the sheet bundle SA. If all of the first to third pressing members 642*a* to 642*c* and the sheet bundle SA are movable, the shifting time can be reduced.

Next, an exemplary embodiment capable of preventing the sheet bundle SA from deviating from a processing position when the sheet bundle SA is held is described below.

Figure 24A:
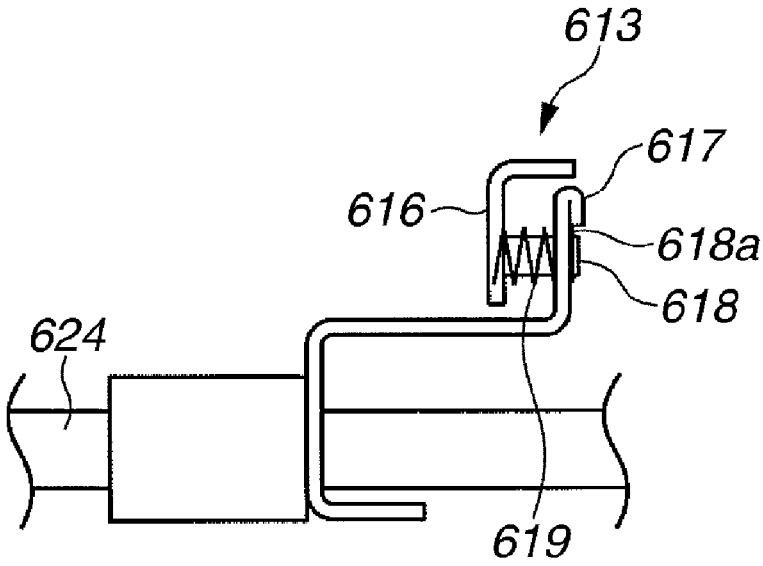
FIGS. 24A and 24B illustrate a configuration of a conveyance claw provided in a booklet processing unit of a sheet processing apparatus according to a fourth exemplary embodiment of the present invention.
Figure 24B:
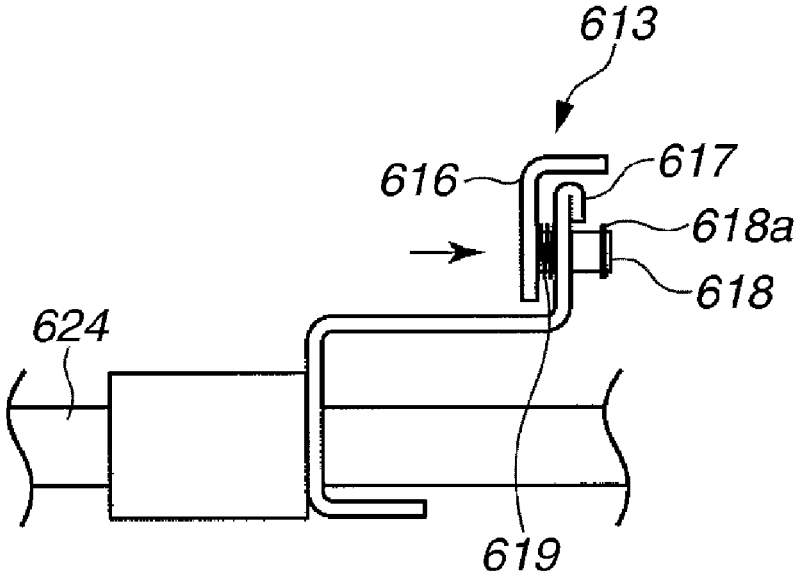

FIGS. 24A and 24B illustrate a configuration of a conveyance claw provided in a booklet processing unit of a sheet processing apparatus according to a fourth exemplary embodiment of the present invention.

As illustrated in FIGS. 24A and 24B, the conveyance claw 613 has a base unit 617 and an abutting member 616. A supporting rail 624, extending in the conveyance direction, supports the base unit 617. The base unit 617 is movable in the conveyance direction. The abutting member 616 can be elastically brought into contact with a rear end of the sheet bundle SA (i.e., the other side opposite to the folded spinal portion). The abutting member 616 is fixed to one end of a slide shaft 618 that can slide relative to the base unit 617.

A compression spring 619, provided around the slide shaft 618, resiliently presses the abutting member 616 to allow the abutting member 616 to depart from an upper edge portion of the base unit 617 along the slide shaft 618. A stopper 618*a* prevents the abutting member 616 and the base unit 617 from being off the slide shaft 618.

FIG. 24A illustrates a state where no external force acts on the abutting member 616. If the abutting member 616 is pushed in this state, the abutting member 616 approaches the base unit 617 while compressing the compression spring 619 as illustrated in FIG. 24B.

Next, the conveyance claw 613 performs the following operation in the sheet bundle processing.

Figure 25A:
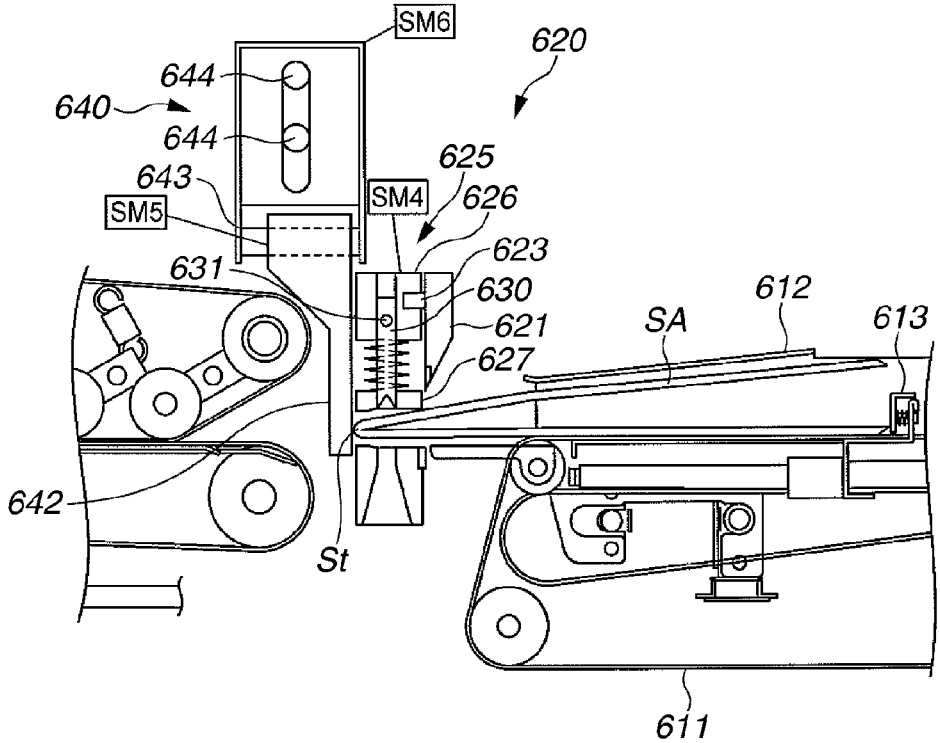
FIGS. 25A and 25B illustrate punch processing that can be performed by the booklet processing unit.

For example, if the above-described punching process mode is set, as illustrated in FIG. 25A, a discharged sheet bundle SA is conveyed by the lower conveyance belt 611 and the conveyance claw 613 and stops when its folded spinal portion St collides against the pressing surface 641.

Then, the side guide pair 612 performs a nipping operation (i.e., an alignment operation) to adjust the position of the sheet bundle SA in the sheet width direction. In this case, the conveyance claw 613 departs from the rear end of the sheet bundle SA. Therefore, the conveyance claw 613 does not interfere with the alignment operation performed by the side guide pair 612. When the alignment operation is completed, the side guide pair 612 departs from the sheet bundle SA.

Next, the sheet bundle SA moves again from the position spaced from the conveyance claw 613 and stops at a position where a clearance between the pressing surface 641 and the abutting member 616 becomes slightly shorter (approximately, 1 mm) than the conveyance length of the sheet bundle SA.

Even if the conveyance claw 613 moves in this manner, the elastic abutting member 616 can approach the base unit 617 while compressing the compression spring 619 as illustrated in FIG. 24B. Thus, even if the length of the sheet bundle SA is not constant, the sheet bundle SA can be surely regulated between the pressing surface 641 and the abutting member 616.

Subsequently, the holding base 626 starts moving downward together with the upper holding plate 627 and the punch 630. In the downward motion of the holding base 626, the upper holding plate 627 abuts an inclined surface of the front cover positioned on the upper part of the sheet bundle SA. However, the sheet bundle SA does not move because the folded spinal portion and the rear end of the sheet bundle SA are regulated by the pressing surface 641 and the abutting member 616.

Figure 25B:
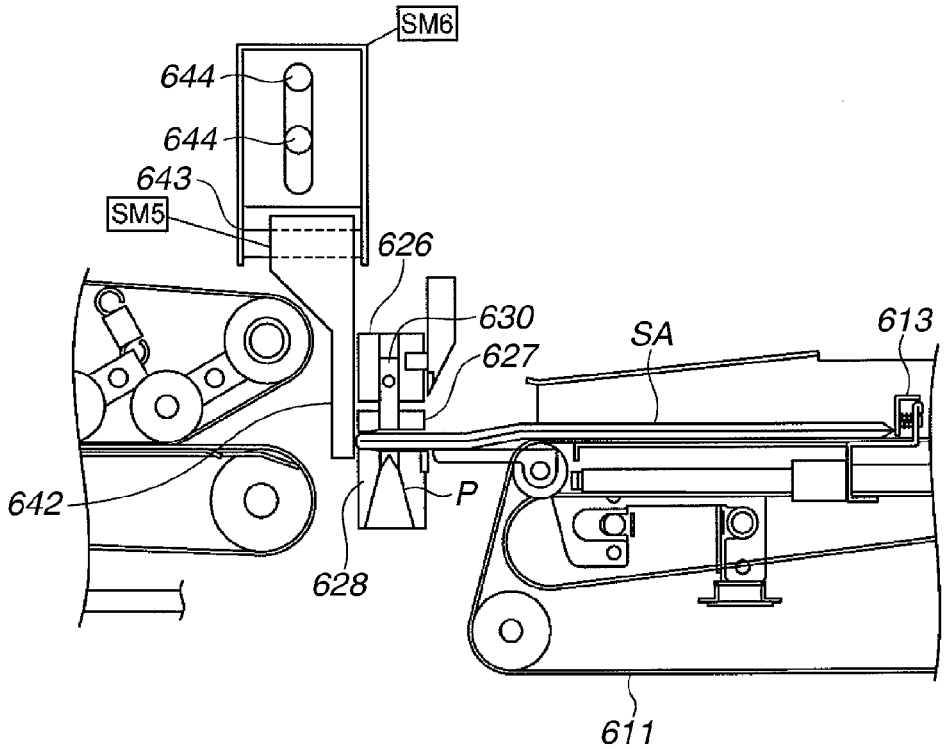

If the holding base 626 moves downward in this manner, the sheet bundle SA can be firmly clamped between the upper and lower holding plates 627 and 628, as illustrated in FIG. 25B. Then, the punch 630 performs a punching operation. The punch 630 can stably open a punch hole at a desired position because the sheet bundle SA does not move during the above-described holding operation and the punching operation applied to the sheet bundle SA.

Figure 26A:
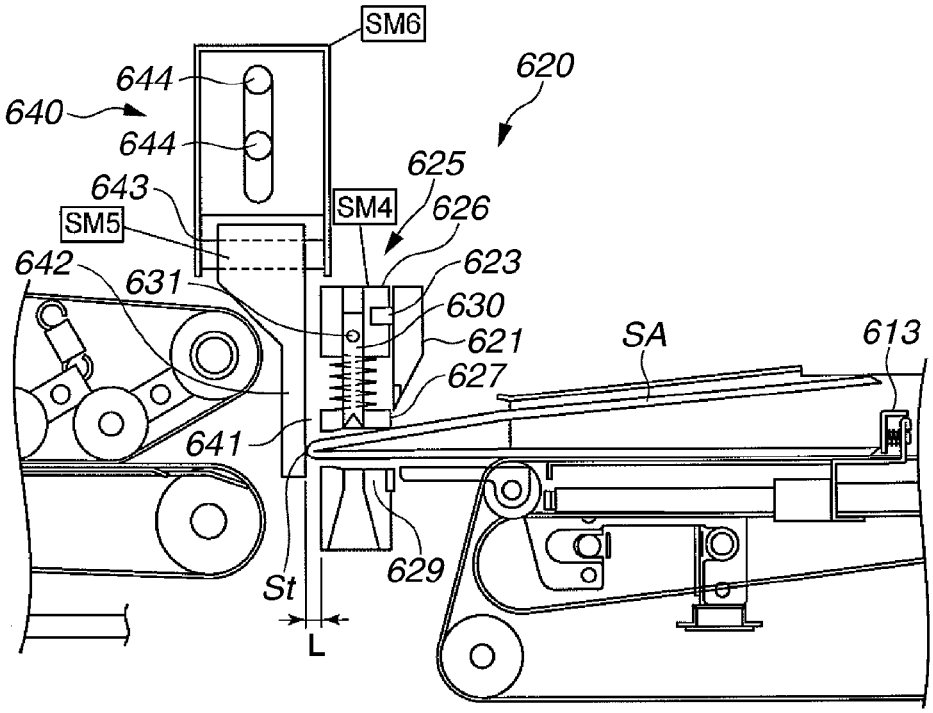
FIGS. 26A and 26B illustrate cornering processing that can be performed by the booklet processing unit.

If the cornering mode is selected, a discharged sheet bundle SA is conveyed by the lower conveyance belt 611 and the conveyance claw 613 and its folded spinal portion St collides against the pressing surface 641 as illustrated in FIG. 26A. In this case, the conveyance claw 613 reaches a position where the clearance between the pressing surface 641 and the abutting member 616 becomes slightly shorter (approximately, 1 mm) than the conveyance length of the sheet bundle SA.

Thus, the sheet bundle SA can be surely regulated between the pressing surface 641 and the abutting member 616.

Subsequently, the holding base 626 starts moving downward. In the downward motion of the holding base 626, the upper holding plate 627 abuts an inclined surface of the front cover positioned on the upper part of the sheet bundle SA. However, the sheet bundle SA does not move because the folded spinal portion and the rear end of the sheet bundle SA are regulated by the pressing surface 641 and the abutting member 616.

Figure 26B:
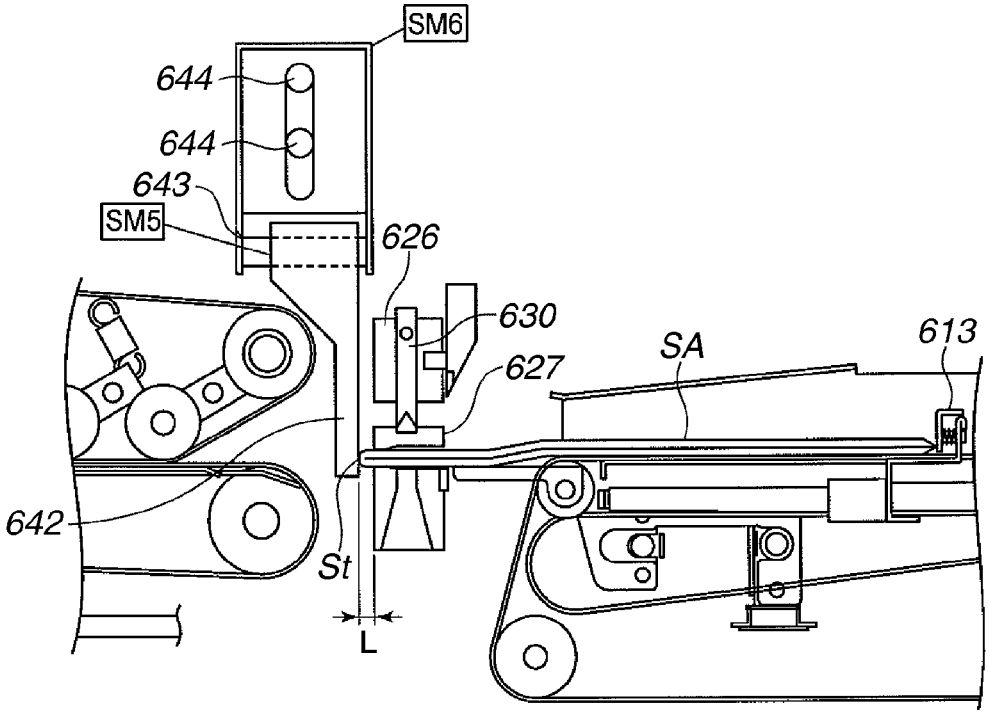
Figure 27A:
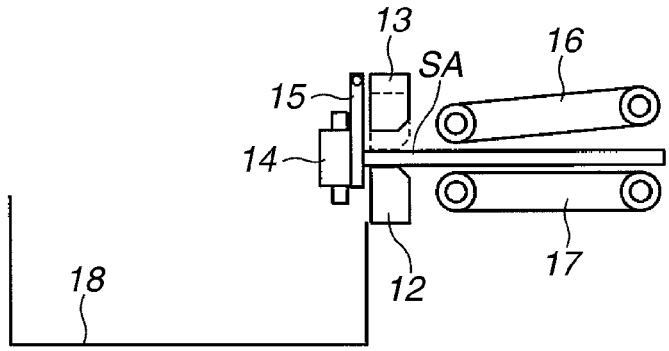
FIGS. 27A, 27B, and 27C illustrate a configuration of a conventional sheet processing apparatus.
Figure 27B:
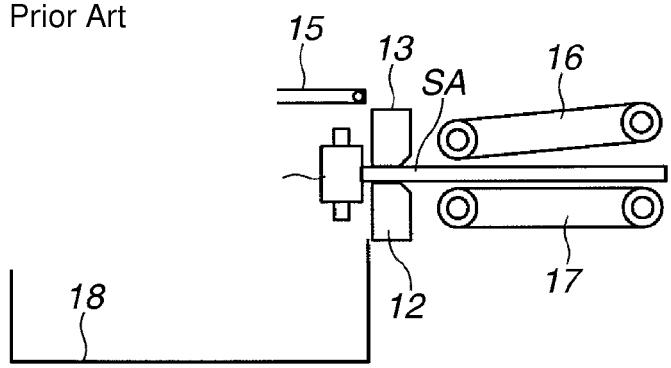
Prior Art FIG.27B
Figure 27C:
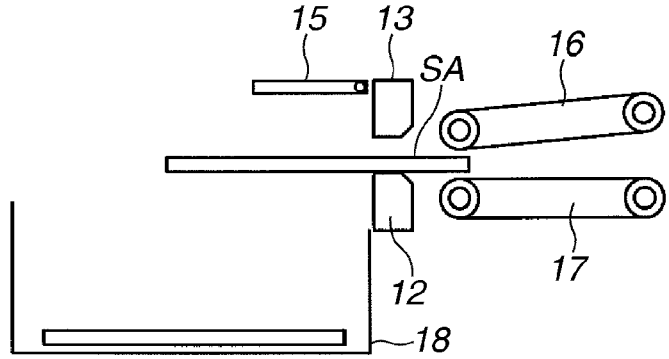
Prior Art FIG.27C
Figure 28A:
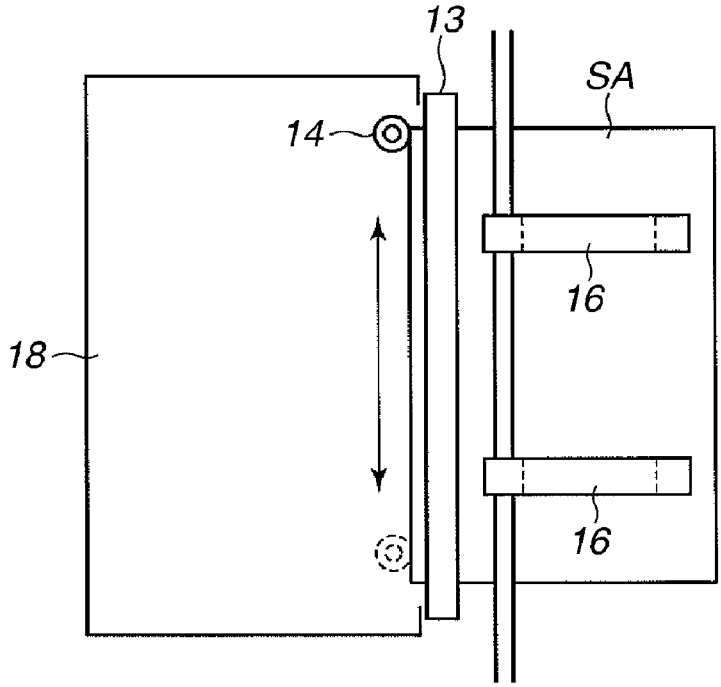
FIG.28A Prior Art
FIGS. 28A and 28B illustrate cornering processing applied to a folded spinal portion of a sheet bundle, which can be performed by a conventional sheet processing apparatus.
Figure 28B:
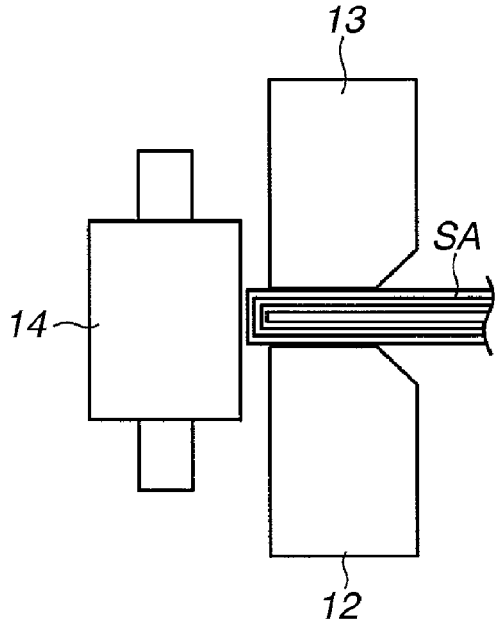
FIG.28B Prior Art

If the holding base 626 moves downward in this manner, the sheet bundle SA can be firmly clamped between the upper and lower holding plates 627 and 628, as illustrated in FIG. 26B. Then, the cornering unit 640 performs cornering process applied to the folded spinal portion of the sheet bundle SA. The cornering unit 640 can stably corner the folded spinal portion because the sheet bundle SA does not move during the above-described holding operation and the punching operation applied to the sheet bundle SA. In other words, the folded spinal portion can be uniformly pressed (cornered) and smoothed. In the state illustrated in FIG. 26B, the punching process mode is not set. Therefore, the punch does not move.

In the present exemplary embodiment, the conveyance claw 613 presses the rear end of the sheet bundle SA with the elastic abutting member 616 that can move relative to the base unit 617. However, the conveyance claw 613 may directly press the rear end of the sheet bundle SA with the base unit 617. In this case, a sheet bundle may deform if its length is irregular when the sheet bundle is regulated. However, the positioned sheet bundle SA can be prevented from moving.

In the above-described exemplary embodiment, the cornering unit performs the cornering process by pressing the folded spinal portion St clamped between the upper and lower holding plates 627 and 628 in the state where the folded spinal portion St protrudes from the upper and lower holding plates 627 and 628. However, it may be possible to cause the pressing surface 641 to enter between the upper and lower holding plates 627 and 628 to perform cornering process in a state where the folded spinal portion St is placed between the upper and lower holding plates 627 and 628.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application Nos. 2008-180984 filed Jul. 11, 2008 and 2009-147447 filed Jun. 22, 2009, which are hereby incorporated by reference herein in their entirety.

What is claimed is:

1. A sheet processing apparatus that performs bookbinding process on a folded sheet bundle, comprising:

a holding portion configured to hold the folded sheet bundle; and a pressing member configured to press a folded spinal portion of the folded sheet bundle to deform the folded spinal portion into a square shape, the pressing member including a plurality of separate pressing members arranged in a direction along a folding line of the folded spinal portion; and a controller configured to control the pressing member and the holding portion, so that at least one of the pressing member and the holding portion can move in a direction perpendicular to a folding line of the folded spinal portion of the folded sheet bundle held by the holding portion so that the pressing member approaches the folding line of the folded spinal portion to press the folded spinal portion, and so that an operation for pressing the folded spinal portion is successively performed from a separated pressing member positioned on a center of the folded spinal portion to a separated pressing member positioned on both ends of the folded spinal portion in the direction along the folding line of the folded spinal portion.

2. The sheet processing apparatus according to claim 1, further comprising:

a conveyance path along which the folded sheet bundle is conveyed, wherein the pressing member is movable between a protruded position where the pressing member blocks the conveyance path and a retreat position where the pressing member is spaced from the conveyance path, and the pressing member protrudes into the conveyance path before the folded sheet bundle is held by the holding portion, to stop the folded sheet bundle by causing the folded spinal portion of a conveyed the folded sheet bundle to abut against the pressing member.

3. The sheet processing apparatus according to claim 2, further comprising:

a pushing member configured to move the folded sheet bundle to push the folded spinal portion of the folded sheet bundle against the pressing member that has protruded into the conveyance path, wherein the holding portion holds the folded sheet bundle in a state where the pushing member pushes the folded spinal portion of the folded sheet bundle against the pressing member.

4. The sheet processing apparatus according to claim 3, wherein the pushing member includes an abutting member that can elastically abut against another edge portion opposite to the folded spinal portion of the folded sheet bundle.

5. The sheet processing apparatus according to claim 1, wherein a pressing amount by the pressing member, in a case where the pressing surface of the pressing member presses the folded spinal portion of the folded sheet bundle, is increased in proportion to the number of sheets constituting the folded sheet bundle.

6. The sheet processing apparatus according to claim 1, wherein a pressing time by the pressing member in a case where the pressing surface of the pressing member presses the folded spinal portion of the folded sheet bundle, is increased in proportion to the number of sheets constituting the sheet bundle.

7. The sheet processing apparatus according to claim 1, further comprising:

a shifting portion configured to shift at least one of the plurality of separate pressing members and the folded sheet bundle in the direction along the folding line of the folded spinal portion, wherein after the operation for pressing the folded spinal portion by the plurality of separated pressing members is completed, the plurality of separate pressing members are moved to a direction opposed to a pressing direction, and the plurality of separate pressing members performs again the operation for pressing the folded spinal portion in a state where one of the plurality of separate pressing members and the folded sheet bundle is shifted by the shifting portion.

8. An image forming apparatus, comprising:

an image forming portion configured to form an image on a sheet; and a sheet processing apparatus that processes a bundle of sheets on which images are formed by the image forming portion, wherein the sheet processing apparatus includes comprising:

a holding portion configured to hold a folded sheet bundle;

a pressing member configured to press a folded spinal portion of the folded sheet bundle to deform the folded spinal portion into a square shape, the pressing member including a plurality of separate pressing members arranged in a direction along a folding line of the folded spinal portion; and a controller configured to control the pressing member and the holding portion, so that at least one of the pressing member and the holding portion can move in a direction perpendicular to a folding line of the folded spinal portion of the folded sheet bundle held by the holding portion so that the pressing member approaches the folding line of the folded spinal portion to press the folded spinal portion, and so that an operation for pressing the folded spinal portion is successively performed from a separate pressing member positioned on a center of the folded spinal portion to a separate pressing member positioned on both ends of the folded spinal portion in the direction along the folding line of the folded spinal portion.

9. The image forming apparatus according to claim 8, wherein the sheet processing apparatus further includes:

a conveyance path along which the folded sheet bundle is conveyed, wherein the pressing member is movable between a protruded position where the pressing member blocks the conveyance path and a retreat position where the pressing member is spaced from the conveyance path, and the pressing member protrudes into the conveyance path before the folded sheet bundle is held by the holding portion, to stop the folded sheet bundle by causing the folded spinal portion of the folded sheet bundle to abut against the pressing member.

10. The image forming apparatus according to claim 9, wherein the sheet processing apparatus further includes:

a pushing member configured to move the folded sheet bundle to push the folded spinal portion of the folded sheet bundle against the pressing member that has protruded into the conveyance path, wherein the holding portion holds the folded sheet bundle in a state where the pushing member pushes the folded spinal portion of the folded sheet bundle against the pressing member.

11. The image forming apparatus according to claim 10, wherein the pushing member includes an abutting member that can elastically abut against another edge portion opposite to the folded spinal portion of the folded sheet bundle.

12. The image forming apparatus according to claim 8, wherein a pressing amount by the pressing member, in a case where the pressing surface of the pressing member presses the folded spinal portion of the folded sheet bundle, is increased in proportion to the number of sheets constituting the folded sheet bundle.

13. The image forming apparatus according to claim 8, wherein a pressing time by the pressing member in a case where the pressing surface of the pressing member presses the folded spinal portion of the folded sheet bundle, is increased in proportion to the number of sheets constituting the sheet bundle.

14. The image forming apparatus according to claim 8, wherein the sheet processing apparatus further includes:

a shifting portion configured to shift at least one of the plurality of separate pressing members and the folded sheet bundle in the direction along the folding line of the folded spinal portion, wherein after the operation for pressing the folded spinal portion by the plurality of separated pressing members is completed, the plurality of separate pressing members are moved to a direction opposed to a pressing direction, and the plurality of separate pressing members performs again the operation for pressing the folded spinal portion in a state where one of the plurality of separate pressing members and the folded sheet bundle is shifted by the shifting portion.

* * * * *